US009689052B2

(12) United States Patent
Murakami et al.

(10) Patent No.: US 9,689,052 B2
(45) Date of Patent: Jun. 27, 2017

(54) VERY THIN STEEL SHEET AND PRODUCTION METHOD THEREOF

(75) Inventors: Hidekuni Murakami, Tokyo (JP); Seiichi Tanaka, Tokyo (JP); Keiichiroh Torisu, Tokyo (JP); Akihiro Jinno, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 1035 days.

(21) Appl. No.: 13/321,108

(22) PCT Filed: May 17, 2010

(86) PCT No.: PCT/JP2010/058681

§ 371 (c)(1),
(2), (4) Date: Nov. 17, 2011

(87) PCT Pub. No.: WO2010/134616

PCT Pub. Date: Nov. 25, 2010

(65) Prior Publication Data

US 2012/0067469 A1 Mar. 22, 2012

(30) Foreign Application Priority Data

May 18, 2009 (JP) ..... 2009-119378

(51) Int. Cl.

| | |
|---|---|
| ***C22C 38/14*** | (2006.01) |
| ***C21D 9/46*** | (2006.01) |
| ***C21D 9/56*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |

(52) U.S. Cl.

CPC ..... *C21D 9/46* (2013.01); *C21D 9/56* (2013.01); *C22C 38/001* (2013.01); *C22C 38/004* (2013.01); *C22C 38/02* (2013.01); *C22C 38/04* (2013.01); *C22C 38/06* (2013.01); *C22C 38/12* (2013.01); *C22C 38/14* (2013.01); *C21D 2201/03* (2013.01); *C21D 2211/004* (2013.01)

(58) Field of Classification Search

CPC ..... C22C 38/02

See application file for complete search history.

(56) References Cited

U.S. PATENT DOCUMENTS 6,042,952 A * 3/2000 Aratani et al. ..... 428/648

FOREIGN PATENT DOCUMENTS

| | | | | |
|---|---|---|---|---|
| CN | 101275196 | A | 10/2008 | |
| EP | 1806420 | A1 * | 7/2007 | ..... C21D 8/1216 |
| EP | 2003221 | A1 * | 12/2008 | ..... C21D 1/06 |
| JP | 5-287449 | A | 11/1993 | |
| JP | 8-41548 | A | 2/1996 | |
| JP | 8-120402 | A | 5/1996 | |
| JP | 8-199301 | A | 8/1996 | |
| JP | 10-183240 | A | 7/1998 | |
| JP | 11-71634 | A | 3/1999 | |
| JP | 11-315346 | A | 11/1999 | |
| JP | 11315346 | A * | 11/1999 | ..... C22C 38/00 |
| JP | 2001-49383 | A | 2/2001 | |
| JP | 3247139 | B2 | 1/2002 | |
| JP | 2004323905 | A * | 11/2004 | ..... C21D 8/1216 |
| JP | 2005-330506 | A | 12/2005 | |
| JP | 2007-31840 | A | 2/2007 | |
| JP | 2007-204800 | A | 8/2007 | |
| JP | 2007-291434 | A | 11/2007 | |
| KR | 10-2009-0007783 | A | 1/2009 | |
| WO | WO 2006/027854 | A1 | 3/2006 | |

OTHER PUBLICATIONS

International Search Report for PCT/JP2010/058681, mailed on Aug. 24, 2010.

* cited by examiner

*Primary Examiner* — Roy King
*Assistant Examiner* — Jophy S Koshy
(74) *Attorney, Agent, or Firm* — Birch, Stewart, Kolasch & Birch, LLP

(57) ABSTRACT

The present invention provides a very thin steel sheet and production method thereof that, in a very thin steel sheet of 0.4 mm or less thickness, enable production at low addition of special elements, simultaneous achievement of both good workability and anti-aging property, and stable passing of even wide coil in a continuous annealing process, which very thin steel sheet and production method.

6 Claims, No Drawings

VERY THIN STEEL SHEET AND PRODUCTION METHOD THEREOF

TECHNICAL FIELD

This invention relates to very thin steel sheet, typically container steel sheet used in food cans, drink cans, various kinds of cases, and the like, and a production method therefor. Specifically, it provides very thin steel sheet that enables high productivity in the steel sheet manufacturing sector and is excellent in anti-aging property and formability.

BACKGROUND ART

In steel sheet to be worked, it is generally required to establish workability and strength with a good balance and minimize aging in order to avoid occurrence of stretcher strain that degrades the surface property of the product after forming.

On the other hand, it is preferable to enable cost reduction from the aspect of steel sheet production and enable annealing at low temperature from the aspect of productivity, but thin material tends to experience steel sheet buckling, called heat buckling, in the continuous annealing process during sheet production, and to avoid this, annealing must be made possible at a low temperature with a low recrystallization temperature. Particularly in the case where the sheet width of the passed coil is wide, heat buckling readily occurs owing to the difficulty of uniform external force control across the whole sheet width, so that in a very thin material the inability to provide wide coils has been a perpetual issue notwithstanding the need for wide coils from the viewpoint of productivity improvement during utilization by the steel sheet user.

For improving workability and suppressing stretcher strain, Patent Documents 1 to 6 listed below set out techniques for anti-aging by lowering C and N content and further adding Ti, Nb, B and other carbonitride-forming elements. However, in the thin material to which the present invention is directed, their use is limited from the viewpoint of heat buckling, because these elements greatly increase the recrystallization temperature of the steel sheet. Further, with heavy addition, the impact of alloying cost cannot be avoided, and health problems are also a concern in food-related materials.

Further, Patent Document 7 discloses can steel sheet of reduced C content that is excellent in deep drawability and earing property. In addition, stock sheet for surface treatment and can-making steel sheet of reduced N and Al content are disclosed in Patent Document 8, which is aimed at achieving fine precipitation of TiN and NbC in order to prevent surface roughness, and in Patent Document 9, which is aimed at lowering iron ion elution from the steel sheet surface. Further, Patent Document 10 teaches a method of producing can-making steel sheet of reduced C and N content that is aimed at lowering production cost.

However, materials of reduced C and N content such as set out in the aforesaid Patent Documents 1 to 10 have reduced strength, so that in a thin material that is the object of the present invention, a concern of ensuring container strength arises, and when Mn, Si, P or other strengthening elements are added to establish strength, surface property issues arise regarding platability, corrosion resistance and the like. Further, although a method of re-cold-rolling after annealing has been implemented as a method for strengthening without addition of strengthening elements, a marked decline in workability cannot be avoided.

Further, although container manufacturing processes frequently use welding to form the container itself or a handle or the like thereof, the weld strength of a material of low C and N content is often insufficient at the structural change in the steel cooling process. Further, as a method for easily measuring weld pass/fail at the welding site, a test, known as the Hyne Test, is performed in which the weld seam is pulled to tear the weld at the weld heat-affected zone and the state of the weld seam at this time is investigated, but if the weld seam is too soft at this time, the weld seam breaks to make normal testing impossible, thereby not only hindering the determination of suitable welding conditions but also making it impossible to select a material having good weldability. Further, when the C and N contents are low, the crystal structure at the heat-affected zone during welding becomes coarse and soft, so that strain concentrates in the heat-affected zone softened during processing of the weld, thereby degrading workability.

Further, in the course of producing a low C and N steel, carburization and nitrogen absorption may occur, depending on the production conditions, to vary the material properties in the coil or the production lot. Depending on the amount of added Ti, Nb and the like, the form and amount of the precipitates readily vary with the heat history of the production process, and this may also cause uneven material properties in the coil.

In other words, in these conventional technologies, steel sheet has not been obtained that is, on an elevated level, satisfactory in properties such as strength and workability, anti-aging property and platability, and to as far as heat buckling and alloying cost, plus weld zone properties, as well as productivity and production cost with attention to material handling ease during welding.

PRIOR ART REFERENCES

Patent Documents

Patent Document 1 Japanese Patent No. 3247139

Patent Document 2 Unexamined Patent Publication (Kokai) No. 2007-204800

Patent Document 3 Unexamined Patent Publication (Kokai) No. 5-287449

Patent Document 4 Unexamined Patent Publication (Kokai) No. 2007-31840

Patent Document 5 Unexamined Patent Publication (Kokai) No. 8-199301

Patent Document 6 Unexamined Patent Publication (Kokai) No. 8-120402

Patent Document 7 Unexamined Patent Publication (Kokai) No. 11-315346

Patent Document 8 Unexamined Patent Publication (Kokai) No. 10-183240

Patent Document 9 Unexamined Patent Publication (Kokai) No. 11-071634

Patent Document 10 Unexamined Patent Publication (Kokai) No. 8-041548.

SUMMARY OF THE INVENTION

Problem to be Solved by the Invention

The present invention is directed to the task of providing very thin steel sheet and a production method thereof which, in a thin steel sheet of 0.4 mm or less thickness, limits the steel composition to within a specified range in which no problem regarding platability or food hygiene arises, so as to inhibit occurrence of problems regarding workability, aging, weld zone properties and the like, hold down recrystallization temperature and maintain enhanced high-temperature strength to improve even wide coil passing performance in continuous annealing, thereby enabling stable production.

Means for Solving the Problems

With the conventionally utilized Ti- and Nb-added ultra-low carbon steel as a base, the present invention develops further thereon to achieve the aforesaid task and solve the problems that are a particularly a concern for thin steel sheet. Specifically, in Ti- and Nb-added steel, the present invention limits Ti and Nb to specified ranges and by further increasing N content and adding abundant Al, precipitates carbides and nitrides in desirable condition, thereby not only enhancing the properties but, also greatly improving productivity.

Concretely, the present invention has the features (a) to (C) set out below.

(a) C content is lowered while establishing an N content equal to or greater than the C content by not reducing it extremely.

N is combined with the Ti, Nb and Al indicated in (b) and (c) to form nitrides and produce the effects of establishing normal-temperature strength, establishing high-temperature strength, and optimizing recrystallization temperature.

Further, solid solution N present during cold rolling increases accumulation of cold-rolling strain to promote recrystallization during annealing. In addition, weld zone strength and workability are imparted by controlling the change in crystal structure during welding so as to appropriately impart hardenability. Further, in the weld evaluation test (Hyne Test), normal testing is enabled by increasing weld seam strength to inhibit breaking at the weld seam.

(b) At least one of Ti and Nb is defined as a required element and added within a specified limited range. These elements are formed as nitrides and carbides to establish normal-temperature strength, establish high-temperature strength, produce an effect of optimizing recrystallization temperature, and also enhance anti-aging property by inhibiting aging induced by solute C and/or solute N.

(c) Al is heavily added. As a result of this and (a), much AlN is formed to establish normal-temperature strength, establish high-temperature strength, produce an effect of optimizing recrystallization temperature, and also enhance anti-aging property by inhibiting aging by induced solute N.

The gist of the present invention is the substance set out below as set forth in the claims.

(1) A very thin steel sheet characterized in containing, in mass %,

C: 0.0004 to 0.0108%,
N: 0.0032 to 0.0749%,
Si: 0.0001 to 1.99%,
Mn: 0.006 to 1.99%,
S: 0.0001 to 0.089%,
P: 0.001 to 0.069%, and
Al: 0.070 to 1.99%;

further containing one or both of Ti and Nb at

Ti: 0.0005 to 0.0804%, and
Nb: 0.0051 to 0.0894%,
within the range of
Ti+Nb: 0.0101 to 0.1394%;

further satisfying the relationships of $N-C \geq 0.0020\%$, $C+N \geq 0.0054\%$, $Al/N > 10$, $(Ti+Nb)/Al \leq 10.8$, $(Ti/48+Nb/93) \times 12/C \geq 0.5$, and $0.31 < (Ti/48+Nb/93)/(C/12+N/14) \leq 2.0$; having a balance of iron and unavoidable impurities; and having a thickness of 0.4 mm or less.

(2) A very thin steel sheet as set out in (1), characterized in having an average grain diameter of 30 μm or less.

(3) A very thin steel sheet as set out in (1) or (2), characterized in having a yield point elongation after aging at 210° C. for 30 min of 4.0% or less.

(4) A very thin steel sheet as set out in (1) or (2), characterized by having a superficial hardness HR30T of 51 to 71, a yield stress of 200 to 400 MPa, a tensile strength of 320 to 450 MPa, and a total elongation of 15 to 45%.

(5) A very thin steel sheet as set out in (3), characterized by having a superficial hardness HR30T of 51 to 71, a yield stress of 200 to 400 MPa, a tensile strength of 320 to 450 MPa, and a total elongation of 15 to 45%.

(6) A method of producing a very thin steel sheet set out in any of (1) to (5), which method of producing a very thin steel sheet is characterized by heating and hot rolling a slab or cast slab having a composition set out in (1), thereafter conducting cold rolling at a cold reduction of 80 to 99%, and performing annealing to attain a recrystallization rate of 100%.

(7) A method of producing a very thin steel sheet as set out in (6), characterized in that the annealing after the cold rolling is conducted by continuous annealing and the annealing temperature at this time is 641 to 789° C.

(8) A method of producing a very thin steel sheet as set out in (6) or (7), characterized by conducting re-cold-rolling by dry rolling after the annealing, with the reduction thereof made 5% or less.

Effect of the Invention

According to the present invention, it is possible to obtain a steel sheet that in addition to being inhibited in aging property also has a good balance between strength and ductility and good welding-related properties. Moreover, as the recrystallization temperature of the invention steel is lower than that of conventional steels, low-temperature annealing is possible, and further, since high-temperature strength is high, a very thin steel sheet and production method thereof can be provided that enable high-efficiency production that avoids occurrence of heat buckling particularly in material of thin thickness.

MODES FOR CARRYING OUT THE INVENTION

The present invention is explained in detail below.

First, explanation is given regarding the thickness of the steel sheet to which the present invention is directed.

The present invention is limited to a steel sheet of a thickness of 0.40 mm or less. This is because, notwithstanding that the effect of the present invention is itself exhibited irrespective of sheet thickness, a major object of the present invention is to improve passing performance during continuous annealing, but since passing problems are rare during continuous annealing of material of a thickness greater than 0.40 mm, the very issue is absent.

Further, unlike the steel sheet to which the present invention is directed, a thick material of a thickness greater than 0.40 mm requires still higher elongation and higher r-value, and generally therefore is often annealed at a high temperature of, say 800° C. or higher, but the effect of the present invention may be small at such a high temperature. In other words, the effect of the present invention is not one that emerges from a technology for conventional thick materials, and at the same time, is one whose application to thick material production technology is meaningless. The thickness of the material to which it is applied is therefore limited to 0.40 mm or less. It is preferably 0.30 mm or less, still more preferably 0.20 mm or less, still more preferably 0.15 mm or less, still more preferably 0.12 mm or less, and still more preferably 0.10 mm or less.

Next, the composition will be explained. All components are expressed in mass %.

C generally is better when low from the point of workability and the like, but since higher is better where the purpose is to lower the degassing load in the steelmaking process, the upper limit is defined as 0.0108%. Particularly in the case where minimal aging and good ductility are required, the properties can be improved markedly by lowering C to as far as 0.0068%, preferably 0.0048% or less, and if 0.0038% or less, the aging problem may be avoidable depending on the amount of added Ti and Nb. Still more preferably, it is 0.0033% or less, still more preferably 0.0029% or less, still more preferably 0.0026% or less, still more preferably 0.0023% or less, and still more preferably 0.0018% or less, and if made 0.0013% or less, the aging problem can be avoided without depending on the amounts of added Ti and Nb. On the other hand, however, C reduction in the range of 0.01% or less leads to increased degassing cost and also makes occurrence of material quality change owing to C content fluctuation caused by carburization and the like more likely, so the lower limit is defined as 0.0004%. It is preferably 0.0006% or greater, still more preferably 0.0011% or greater and still more preferably 0.0016% or greater.

On top of this, a still higher content is beneficial from the viewpoints of realization of high-temperature strength, lowering of recrystallization temperature, and weld workability by inhibiting structural coarsening of heat-affected zones during welding.

It is preferably 0.0021% or greater, still more preferably 0.0026% or greater, still more preferably 0.0031% or greater, and still more preferably 0.0036% or greater. When the C content goes up, a need arises to increase the amount of Ti and Nb addition from the viewpoint of aging property.

N is an important element for ensuring the anti-aging property and strength that are key effects in the present invention. N is an important element for ensuring not only product strength but also high temperature strength in the annealing process, and, further, for ensuring weld workability by inhibiting structural coarsening of the heat-affected zone during welding.

In the present invention, as N forms nitrides of some kind at many portions, the upper limit is defined as 0.0749% because in some cases too much inclusion may degrade workability. Further, although the balance with nitride-forming element content is a factor, the N content may in some cases markedly degrade anti-aging property and is therefore preferably held to 0.0549% or less. It is still more preferably 0.0299% or less, still more preferably 0.0199% or less, still more preferably 0.0149% or less, still more preferably 0.0129% or less, still more preferably 0.0109% or less, still more preferably 0.0099% or less, still more preferably 0.0089% or less, still more preferably 0.0079% or less, still more preferably 0.0069% or less, still more preferably 0.0059% or less, still more preferably 0.0049% or less, and still more preferably 0.0039% or less. On the other hand, when too low, the amount of nitrides becomes inadequate, which merely increases vacuum degassing cost without being able to achieve the effects of the present invention for realizing high-temperature strength, product strength, and weld workability by inhibiting structural coarsening of heat-affected zones during welding.

The lower limit is therefore defined as 0.0032% or less. Considering the fact that required product strength may not be achieved and the fact that it may be hard to ensure the high strength that is a feature of the present invention, it is preferably 0.0042% or greater, still more preferably 0.0047% or greater, still more preferably 0.0052% or greater, still more preferably 0.0057% or greater, still more preferably 0.0062% or greater, still more preferably 0.0072% or greater, still more preferably 0.0082% or greater, still more preferably 0.0092% or greater, still more preferably 0.0102% or greater, still more preferably 0.0122% or greater, still more preferably 0.0142% or greater, still more preferably 0.0162% or greater, still more preferably 0.0182% or greater, still more preferably 0.0202% or greater, still more preferably 0.0222% or greater, still more preferably 0.0242% or greater, still more preferably 0.0272% or greater, still more preferably 0.0302% or greater, still more preferably 0.0352% or greater, and still more preferably 0.0402% or greater.

Si is limited to the range of 0.0001 to 1.99% in order to achieve anti-aging property by controlling carbide and nitride morphology through transformation behavior during hot rolling. From the aspects of ensuring platability and ductility, it is preferably 1.49% or less, still more preferably 0.99% or less, still more preferably 0.49% or less, still more preferably 0.29% or less, still more preferably 0.19% or less, still more preferably 0.099% or less, still more preferably 0.049% or less, still more preferably 0.029% or less, still more preferably 0.019% or less, and still more preferably 0.014% or less.

On the other hand, aggressive addition for ensuring product strength and establishing high-temperature strength in the annealing process is also possible, and is preferably 0.0006% or greater, still more preferably 0.0011% or greater, still more preferably 0.0016% or greater, still more preferably 0.0021% or greater, still more preferably 0.0041% or greater, still more preferably 0.0061% or greater, still more preferably 0.0081% or greater, and still more preferably 0.011% or greater.

Mn is limited to the range of 0.006 to 1.99% in order to achieve anti-aging property by controlling carbide, nitride and sulfide morphology through transformation behavior during hot rolling. From the aspects of ensuring platability and ductility, it is preferably 1.49% or less, still more preferably 1.29% or less, still more preferably 0.99% or less, still more preferably 0.79% or less, still more preferably 0.59% or less, still more preferably 0.49% or less, still more preferably 0.39% or less, still more preferably 0.29% or less, and still more preferably 0.19% or less. On the other hand, aggressive addition for ensuring product strength and establishing high-temperature strength in the annealing process is also possible, and is preferably 0.006% or greater, still more preferably 0.011% or greater, still more preferably 0.016% or greater, still more preferably 0.021% or greater, still more preferably 0.041% or greater, still more preferably 0.061% or greater, still more preferably 0.081% or greater, and still more preferably 0.11% or greater.

S is limited to the range of 0.0001 to 0.089% in order to achieve anti-aging property by controlling sulfide morphology through transformation behavior during hot rolling and simultaneously controlling C and N grain boundary segregation behavior. When sulfides are abundant, fractures tend to occur with these as starting points, so from the viewpoint of ensuring ductility, it is preferably 0.059% or less, still more preferably 0.049% or less, still more preferably 0.039% or less, still more preferably 0.029% or less, still more preferably 0.019% or less, still more preferably 0.014% or less, still more preferably 0.011% or less, still more preferably 0.009% or less, still more preferably 0.007% or less, still more preferably 0.005% or less, and still more preferably 0.004% or less. On the other hand, aggressive addition is possible due to the effect of inhibiting carbon aging (aging caused by C) by formation of Ti carbosulfides, and is preferably 0.0006% or greater, still more preferably 0.0011% or greater, still more preferably 0.0021% or greater, still more preferably 0.0031% or greater, still more preferably 0.0041% or greater, still more preferably 0.0051% or greater, still more preferably 0.0061% or greater, still more preferably 0.0071% or greater, still more preferably 0.0081% or greater, still more preferably 0.0091% or greater, still more preferably 0.0101% or greater, still more preferably 0.011% or greater, still more preferably 0.012% or greater, still more preferably 0.013% or greater, still more preferably 0.014% or greater, still more preferably 0.016% or greater, still more preferably 0.018% or greater, still more preferably 0.021% or greater, and still more preferably 0.026% or greater.

P is limited to the range of 0.001 to 0.069% in order to achieve anti-aging property by controlling the grain boundary segregation behavior of C and N. From the viewpoint of ensuring anti-aging property, it is preferably 0.059% or less, still more preferably 0.049% or less, still more preferably 0.039% or less, still more preferably 0.029% or less, still more preferably 0.019% or less, still more preferably 0.014% or less, still more preferably 0.011% or less, still more preferably 0.009% or less, still more preferably 0.007% or less, still more preferably 0.005% or less, and still more preferably 0.004% or less. On the other hand, aggressive addition is possible from the viewpoint of ensuring strength by grain refinement and ensuring high-temperature strength in the annealing process, and is preferably 0.0031% or greater, still more preferably 0.0051% or greater, still more preferably 0.0071% or greater, still more preferably 0.0091% or greater, still more preferably 0.011% or greater, still more preferably 0.016% or greater, still more preferably 0.021% or greater, and still more preferably 0.026% or greater.

Al, while generally added for deoxidation, requires control in the present invention also with consideration to the amounts of other nitride-forming elements added to control nitride morphology as set out below. Since oxides in the steel may increase to lower workability at too low content and platability declines when contained excessively, it is defined as 0.070 to 1.99%. Also considering the cost of inclusion, it is preferably 1.49% or less, still more preferably 0.99% or less, still more preferably 0.69% or less, still more preferably 0.49% or less, still more preferably 0.44% or less, still more preferably 0.39% or less, still more preferably 0.34% or less, still more preferably 0.29% or less, still more preferably 0.24% or less, still more preferably 0.195% or less, and still more preferably 0.145% or less. On the other hand, aggressive addition is effective from the viewpoint of inhibiting nitrogen aging (aging caused by N) and ensuring high-temperature strength in the annealing process, and is preferably 0.076% or greater, still more preferably 0.081% or greater, still more preferably 0.086% or greater, still more preferably 0.096% or greater, still more preferably 0.106% or greater, still more preferably 0.116% or greater, still more preferably 0.126% or greater, still more preferably 0.146% or greater, still more preferably 0.166% or greater, still more preferably 0.186% or greater, still more preferably 0.206% or greater, still more preferably 0.256% or greater, still more preferably 0.306% or greater, still more preferably 0.406% or greater, and still more preferably 0.506% or greater.

At least one of Ti and Nb is a required element in the present invention and must be intentionally included. It is possible to include only one of them or both of them. In producing the effect of the present invention, Nb is preferable to Ti, and where the total amount is the same, more Nb than Ti is preferably included; making Ti<Nb is advantageous for realizing the effect aimed at. The suitable content range of the respective elements is therefore defined in a higher region for Nb than Ti. It should be noted regarding any not added intentionally that in some cases unavoidable entrainment from a raw material or the like is observed, but with regard to these, the amounts contained also exhibit the effect of the present invention and are taken as being includable in the content with respect to the present invention.

Although Ti is included as a carbide-, nitride- and carbonitride-forming element in anticipation of anti-aging property, in order to control the morphology of the carbides, nitrides and carbonitrides, control is required with consideration to the effect on recrystallization temperature, high-temperature strength, and weld workability by inhibiting structural coarsening of heat-affected zones during welding, with attention also to the amounts of other carbide-, nitride- and carbonitride-forming elements contained. At too low content, not only is anti-aging property degraded but high-temperature strength may also be difficult to achieve, while when heavily added, alloying cost rises and, though also dependent on C, N, Al and Nb content, the increase in recrystallization temperature may become considerable owing to formation of excessively large amounts of carbides, nitrides and carbonitrides, and/or strong persistence of solute Ti, so it is defined as 0.0005 to 0.0804%. In the aspect of nitride formation, as mainly Al is added in the present invention, the importance of Ti diminishes. Also considering platability, it is preferably 0.0694% or less, still more preferably 0.0594% or less, still more preferably 0.0494% or less, still more preferably 0.0394% or less, still more preferably 0.0344% or less, still more preferably 0.0294% or less, still more preferably 0.0244% or less, still more preferably 0.0194% or less, still more preferably 0.0174% or less, still more preferably 0.0154% or less, and still more preferably 0.0134% or less. Provided that an adequate amount of Nb is added with a target of 0.010% or greater, or an adequate amount of Al is added with a target of 0.11% or greater, it can be defined as still more preferably 0.0114% or less, still more preferably 0.0094% or less, still more preferably 0.0074% or less, and still more preferably 0.0054% or less. On the other hand, aggressive addition is effective from the viewpoint of inhibiting carbon aging and nitrogen aging and ensuring high-temperature strength in the annealing process, and is preferably 0.0042% or greater, still more preferably 0.0052% or greater, still more preferably 0.0062% or greater, still more preferably 0.0072% or greater, still more preferably 0.0082% or greater, still more preferably 0.0092% or greater, still more preferably 0.0102% or greater, still more preferably 0.0116% or greater, still more preferably 0.0136% or greater, still more preferably 0.0156% or greater, still more preferably 0.0186% or greater, still more preferably 0.0206% or greater, still more preferably 0.0256% or greater, still more preferably 0.0306%, and still more preferably 0.0406% or greater.

Although Nb, like Ti, is included as a carbide-, nitride- and carbonitride-, particularly a carbide- and carbonitride-forming element, in anticipation of anti-aging property, in order to control the morphology of the carbides, nitrides and carbonitrides, control is required with consideration to the effect on recrystallization temperature, high-temperature strength, and weld workability by inhibiting structural coarsening of heat-affected zones during welding, with attention also to the amounts of other carbide-, nitride- and carbonitride-forming elements contained. At too low content, not only may deficient formation of carbides and nitrides markedly degrade of anti-aging property but high-temperature strength may also be difficult to achieve, while when heavily added, alloying cost rises and, though also dependent on C, N, Al and Ti content, the increase in recrystallization temperature may become considerable owing to formation of excessively large amounts of carbides, nitrides and carbonitrides, and/or strong persistence of solute Nb, so it is defined as 0.0051 to 0.0894%. Also considering platability, it is preferably 0.0694% or less, still more preferably 0.0594% or less, still more preferably 0.0494% or less, still more preferably 0.0394% or less, still more preferably 0.0344% or less, still more preferably 0.0294% or less, still more preferably 0.0244% or less, still more preferably 0.0194% or less, still more preferably 0.0174% or less, still more preferably 0.0154% or less, and still more preferably 0.0134% or less. On the other hand, aggressive addition is effective from the viewpoint of inhibiting carbon aging and nitrogen aging and ensuring high-temperature strength in the annealing process, and is preferably 0.0062% or greater, still more preferably 0.0072% or greater, still more preferably 0.0082% or greater, still more preferably 0.0092% or greater, still more preferably 0.0102% or greater, still more preferably 0.0112% or greater, still more preferably 0.0122% or greater, still more preferably 0.0136% or greater, still more preferably 0.0156% or greater, still more preferably 0.0176% or greater, still more preferably 0.0206% or greater, still more preferably 0.0256% or greater, still more preferably 0.0306% or greater, still more preferably 0.0406%, and still more preferably 0.0506% or greater.

[Ti+Nb] must, as pointed out above regarding Ti and Nb, be established at the amount required for carbide, nitride and carbonitride formation and further for achieving high-temperature strength, and needs to be 0.0101% or greater. It is preferably 0.0121% or greater, still more preferably 0.0141% or greater, still more preferably 0.0161% or greater, still more preferably 0.0181% or greater, still more preferably 0.0211% or greater, still more preferably 0.0241% or greater, still more preferably 0.0271% or greater, still more preferably 0.0301% or greater, still more preferably 0.0331% or greater, still more preferably 0.0361% or greater, still more preferably 0.0391% or greater, still more preferably 0.0421% or greater, still more preferably 0.0461% or greater, still more preferably 0.0501% or greater, and still more preferably 0.0561% or greater. On the other hand, while the C, N and Al contents are also a factor, excessive addition causes large amounts of solute Ti and solute Nb to remain, thereby compromising beneficial features of the present invention. The upper limit is therefore set at 0.1394%. It is preferably 0.1194% or less, still more preferably 0.0994% or less, still more preferably 0.0794% or less, still more preferably 0.0594% or less, still more preferably 0.0494% or less, still more preferably 0.0444% or less, still more preferably 0.0394% or less, still more preferably 0.0344% or less, still more preferably 0.0294% or less, still more preferably 0.0244% or less, and still more preferably 0.0194% or less.

Regarding the foregoing component ranges, they are not particularly specified conditions as viewed with respect to the individual components. A characterizing feature of the present invention is that these component ranges are limited to ranges that satisfy special relationships as set out below, whereby highly beneficial effects characteristic of the present invention are exhibited. The control of C, N, Al, Ti and Nb is particularly a feature of the present invention.

C and N, as present in solid solution, enhance the effect of strain accumulation in the cold-rolling process, thereby increasing the driving force for recrystallization, together with accompanying grain refinement, with the result that the recrystallization temperature decreases to enable lowering of the annealing temperature industrially. Further, solute C and solute N, as well as the grain refinement attributable thereto, effectively contribute also to realization of high-temperature strength. They are effective in the aspects of energy conservation and equipment investment, and also contribute to passing performance. Simultaneously with this, they are beneficial elements for imparting suitable hardenability during welding, inhibiting crystal structure coarsening, and achieving weld strength and workability, and by dint of weld hardening enhance the weld fracture resistance to enable Hyne testing.

In the present invention, however, the directions of the control of C and N differ significantly in the following points. As C is relatively easy to reduce in an industrial degassing process, this reduction is made the focus.

On the other hand, N is abundantly present in air and enters the molten steel from the atmosphere, and because it is therefore an element not amenable to reduction by an industrial degassing process, it is included and positively utilized in the steel.

Further, from the viewpoint anti-aging property, there is the matter of having to rely on special elements like Ti and Nb, particularly Nb, to fix solute C in the steel as precipitates, so that the adverse effects are also considerable in the points of, inter alia, cost of inclusion, fine precipitate formation, and recrystallization temperature increase owing to unavoidable persistence of solute Ti and solute Nb. On the other hand, Al can be utilized to fix N in the steel, which is not only advantageous in the point of inclusion cost but also makes it possible to minimize industrially adverse effects because AlN can be coarsened relatively easily in an industrial process and, moreover, the increase in recrystallization temperature by solute Al is small. The various precipitates formed in this way also contribute to favorable control of recrystallization temperature and high-temperature strength through strain accumulation in the cold working process, grain diameter control and the like. From these standpoints, it is necessary in the present invention to control C, N, Al, Ti and Nb to within specific ranges.

[N−C] must be made 0.0020% or greater as a key condition of the present invention. In the present invention steel, which has precisely controlled Ti, Nb and Al precipitates, it is possible to markedly improve high-temperature strength, a particular issue in a thin material, by making this value 0.0020% or greater. Further, as set forth later, utilization of N rather than C is advantageous and exhibits favorable results in aspects that also include precipitate formation. It is preferably 0.0023% or greater, still more preferably 0.0027% or greater, still more preferably 0.0030% or greater, still more preferably 0.0034% or greater, still more preferably 0.0038% or greater, still more preferably 0.0043% or greater, still more preferably 0.0048% or greater, still more preferably 0.0053% or greater, still more preferably 0.0058% or greater, still more preferably 0.0063% or greater, still more preferably 0.0068% or greater, still more preferably 0.0075% or greater, still more preferably 0.0082% or greater, and still more preferably 0.0089% or greater. Although the upper limit is 0.0745% owing to the aforesaid upper limits of C and N, it is preferably defined as 0.0590% or less because production efficiency declines due to the special nature of a production method adopting very low C and high N. Further, when N is abundant, although Al content is also a factor, coarse AlN forms, that when exposed at the steel sheet surface degrades surface properties, while that formed inside the steel sheet may become crack starting points during working. Therefore, it is more preferably, 0.0490% or less, still more preferably 0.0390% or less, and still more preferably 0.0290% or less.

When production efficiency management is strictly required, it is preferably made 0.0240% or less, still more preferably 0.0190% or less, still more preferably 0.0140% or less, still more preferably 0.0120% or less, still more preferably 0.0100% or less, and still more preferably 0.0090% or less.

[C+N] must be made 0.0054% or greater as another key condition of the present invention. In the present invention, C and N play an important role in achieving product strength and high-temperature strength, and further in promoting recrystallization during annealing through accumulation of cold-rolling stress (recrystallization temperature reduction) and in realizing weld strength. When this value is low, problems arise of strength being deficient in the product, passing performance being degraded in annealing, weld strength being inadequate, and Hyne testing being impossible. Further, when this value is low, diminished accumulation of cold-rolling stress, coarse grain diameter before cold rolling, Ti- and Nb-content-dependent increase in solute Ti and solute Nb, and the like act as causes that increase post-cold-rolling recrystallization temperature, which makes high-temperature annealing necessary, thus degrading passing performance in the annealing. Although product strength is generally enhanced by means of increasing the content of Si, Mn, P and the like, the high-temperature strength attained by this method is not adequate and the recrystallization temperature is not lowered, so that desirable features of the present invention are lost.

Therefore, control of [C+N] is important for achieving the desirable features of the present invention. It is preferably 0.0061% or greater, still more preferably 0.0068% or greater, still more preferably 0.0075% or greater, still more preferably 0.0082% or greater, still more preferably 0.0092% or greater, still more preferably 0.0102% or greater, still more preferably 0.0112% or greater, still more preferably 0.0122% or greater, still more preferably 0.0132% or greater, and still more preferably 0.0152% or greater. On the other hand, when excessive, workability and anti-aging property deteriorate. The upper limit is 0.0857% owing to the aforesaid upper limits of C and N. It is preferably 0.0800% or less, still more preferably 0.0600% or less, still more preferably 0.0400% or less, still more preferably 0.0300% or less, still more preferably 0.0250% or less, still more preferably 0.0200% or less, still more preferably 0.0150% or less, still more preferably 0.0120% or less, still more preferably 0.0100% or less, still more preferably 0.0090% or less, still more preferably 0.0080% or less, still more preferably 0.0070% or less, and still more preferably 0.0060% or less.

In addition, the effect of the present invention is evoked by including much Al with respect to N. [Al/N] must be made greater than 10. It is preferably greater than 11.1, still more preferably greater than 12.1, still more preferably greater than 13.1, still more preferably greater than 14.1, still more preferably greater than 15.1, still more preferably greater than 16.1, still more preferably greater than 17.1, still more preferably greater than 18.1, still more preferably greater than 19.1, still more preferably greater than 21.1, still more preferably greater than 23.1, still more preferably greater than 25.1, still more preferably greater than 30.1, still more preferably greater than 35.1, still more preferably greater than 40.1, still more preferably greater than 45.1, and still more preferably greater than 55.1.

Although the upper limit is 781 owing to the aforesaid Al and N limits, when Al content is excessively great, the cost of inclusion rises, and in addition, as set forth above, coarse AlN forms depending on the N content to also become a cause for degradation of steel sheet surface property and workability. Further, at low N with only Al being excessive, if much solute Al remains, nitrogen absorption readily occurs in the production process and the N entering the steel forms fine AlN, thereby amplifying the variation of material properties in the coil. In addition, since melting of AlN becomes difficult during welding and the hardenability of the material declines, the weld softens to hinder normal Hyne testing. Although nothing absolute can be said because of the dependence also on N content, the upper limit of [Al/N] needs to be controlled with attention to these points. It is preferably 70.0 or less, still more preferably 60.0 or less, still more preferably 50.0 or less, still more preferably 40.0 or less, and still more preferably 30.0 or less.

[(Ti+Nb)/Al] is assigned an upper limit and defined as 0.8 or less in line with a basic guideline of the present invention, which is to include a relatively large amount of Al for fixing N and to limit Ti and Nb to the minimum required for fixing N and C and further achieving high-temperature strength by solid solutioning. In order to fully attain the effect of the present invention, it is important to increase Al, so it is preferably 0.6 or less, still more preferably 0.5 or less, still more preferably 0.44 or less, and still more preferably 0.39 or less. At low Al and high Ti and Nb, although also depending on N content, the recrystallization temperature may be inadvertently increased owing to profuse precipitation of N as Ti and Nb five nitrides and increase in solute Ti and solute Nb. Further, if carbides and nitrides of Ti and Nb stabilize excessively, they do not melt under the heat of welding, which may lead to low levels of the solute C and solute N responsible for establishing hardenability and give rise to Hyne testing problems due to weld fracture. It should be noted that since Ti and Nb are required elements, the value of [(Ti+Nb)/Al] does not become zero, and while the lower limit value is 0.005 owing to the aforesaid limitation of the respective elements, it is preferably made 0.04 or greater in order to inhibit the effect of excess Al while realizing the effect of Ti and Nb, still more preferably 0.06 or greater, still more preferably 0.08 or greater, still more preferably 0.10 or greater, still more preferably 0.12 or greater, still more preferably 0.14 or greater, still more preferably 0.16 or greater, still more preferably 0.18 or greater, still more preferably 0.20 or greater, still more preferably 0.22 or greater, still more preferably 0.26 or greater, still more preferably 0.31 or greater, and still more preferably 0.36 or greater. When, on top of Al being low, Ti and Nb are also insufficient, the fixing of C and N becomes inadequate to degrade anti-aging property and diminish the effect of inhibiting grain coarsening, whereby the desired passing performance in annealing may not be attained and weld workability may deteriorate.

[(Ti/48+Nb/93)×12/C] is defined as 0.5 or greater in order to lower solute C and enhance anti-aging property. It is preferably 0.7 or greater, still more preferably 0.9 or greater, still more preferably 1.1 or greater, still more preferably 1.4 or greater, still more preferably 1.7 or greater, and still more preferably 2.0 or greater. When this value is too high, not only do solute Ti and solute Nb increase to cause an inadvertent rise in recrystallization temperature but there is also the matter of carbides and nitrides stabilizing excessively to diminish hardenability during welding and otherwise result in loss of desirable features of the present invention steel, so it is preferably made 15.0 or less. It is still more preferably 10.0 or less, still more preferably 8.0 or less, still more preferably 7.0 or less, still more preferably 6.0 or less, still more preferably 5.0 or less, still more preferably 4.0 or less, and still more preferably 3.0 or less.

[(Ti/48+Nb/93)/(C/12+N/14)] is defined as 2.0 or less in order to avoid excessive recrystallization temperature increase owing to solute Ti and solute Nb, and weld strength deficiency caused by excessive stabilization of carbides and nitrides. It is preferably 1.8 or less, still more preferably 1.7 or less, still more preferably 1.6 or less, still more preferably 1.5 or less, still more preferably 1.4 or less, still more preferably 1.3 or less, still more preferably 1.2 or less, still more preferably 1.1 or less, still more preferably 1.0 or less, still more preferably 0.9 or less, and still more preferably 0.8 or less. When this value is too low, solute C and solute N increase to diminish desirable properties of the present invention steel, so it is made greater than 0.31. It is preferably greater than 0.36, still more preferably greater than 0.41, still more preferably greater than 0.46, still more preferably greater than 0.51, and still more preferably greater than 0.61.

The effects of C, N, Al, Ti and Nb in the present invention vary complexly with, inter alia, the amounts and types of those in solid solution and those forming precipitates, and also the conditions under which their various properties are evaluated, and this complexity may become extreme owing to mutual interaction, so it can hardly be said that the mechanism has been completely elucidated. Notwithstanding, the desirable effects of the present invention can be realized without fail in the steel sheet controlled within the ranges of the present invention.

Various elements are generally incorporated into an industrial product either unavoidably owing to the raw materials or for some purpose. These can be controlled and added in accordance with purpose and intended application, with no complete loss of the effects of the present invention. The anticipated inclusion ranges in the very thin steel sheet for containers that is the main object of the present invention are indicated below as a prima facie guideline:

Cr: 0.49% or less, V: 0.049% or less, Mo: 0.049% or less, Co: 0.049% or less, W: 0.049% or less, Zr: 0.049% or less, Ta: 0.049% or less, B: 0.0079% or less, Ni: 0.29% or less, Cu: 0.069% or less, Sn: 0.069% or less, O: 0.059% or less, REM: 0.019% or less, and Ca: 0.049% or less; preferably Cr: 0.29% or less, V: 0.009% or less, Mo: 0.009% or less, Co: 0.009% or less, W: 0.009% or less, Zr: 0.009% or less, Ta: 0.009% or less, B: 0.0029% or less, Ni: 0.19% or less, Cu: 0.029% or less, Sn: 0.019% or less, O: 0.009% or less, REM: 0.009% or less, and Ca: 0.009% or less; still more preferably Cr: 0.06% or less, V: 0.003% or less, Mo: 0.004% or less, Co: 0.003% or less, W: 0.003% or less, Zr: 0.003% or less, Ta: 0.003% or less, B: 0.0009% or less, Ni: 0.04% or less, Cu: 0.019% or less, Sn: 0.009% or less, O: 0.004% or less, REM: 0.003% or less, and Ca: 0.003% or less; and the balance of iron and unavoidable impurities.

However, the effects and ranges of the present invention are not limited to these, and it goes without saying that, in accordance with the purpose and intended application, it is possible, within generally known ranges, to make additions greater than the above. Nevertheless, caution is necessary regarding the fact the impact of weakening the effects of the present invention is great particularly when, in application to the present invention, carbide-forming elements and/or nitride-forming elements are incorporated in large amounts.

Desirable requirements other than for composition will be discussed next.

In the present invention, as set out above, grain refinement contributes desirably to, inter alia, passing performance in annealing during steel sheet production and weld workability during steel sheet use, so refinement of grain diameter in the product sheet is one preferred mode, characterized by an average grain diameter of 30 μm or less. It is still more preferably 24 μm or less, still more preferably 19 μm or less, still more preferably 14 μm or less, still more preferably 9 μm or less, and still more preferably 7 μm or less. This is due to the fact that it is more advantageous to utilize the grain diameter refining effect when the balance between strength and ductility is taken into consideration and in addition to the fact that surface appearance, e.g., surface roughness, improves. However, since the texture hardens and workability declines with too much refinement, the preferable range is defined as 1 μm or greater, even 2 μm or greater, or even 4 μm or greater.

It is also desirable in the present invention to adjust the material properties to preferred ranges. This is because in the absence of aging property, annealing-process passing performance and other productivity restraints attributable to C, N and the like, it would be possible to design compositions and realize their respective properties as desired without relying on the present invention. In other words, where the substantial industrial significance lies is in the application of the present invention to ranges in which production has up to now been particularly difficult within the restraints on annealing-process passing performance, including aging, sheet thickness and the like.

Aging property is characterized in that yield point elongation in tensile testing conducted after aging at 210° C. for 30 min is 4.0% or less. It is still more preferably 2.9% or less, still more preferably 1.4% or less, still more preferably 0.9% or less, still more preferably 0.4% or less, and, needless to say, absolutely no yield point elongation being exhibited is most preferable.

If this value is 4.0% or less, the steel sheet can be said to have undergone some kind of aging property control, and if it is 2.9% or less, no problem arises in ordinary domestic use. Further, if it is 1.4% or less, no problem arises in use, so long as ordinary, by overseas users, when having crossed the equator in the hold of an overseas transport ship. At 0.4% or less, although yielding phenomenon is observed in the tensile test chart, it is of a level at which an actual tensile sample does not experience a Lüders band or other such problem of a marked surface property change.

Regarding superficial hardness, application is desirably to one of 51 or greater as expressed in the Rockwell superficial hardness scale HR30T ordinarily used for container-purpose steel sheet. This is because for soft materials of less than this, production has been industrially established for ordinary ultra-low carbon steels and BAF steels, even without applying the present invention. It is still more preferably 53 or greater, still more preferably 55 or greater, and still more preferably 57 or greater. On the other hand, regarding the upper limit of hardness, application is desirably to one of 71 or less. This is because for hard materials of greater than this, production has been industrially established for ordinary low-carbon steels and re-cold-rolled steels, even without applying the present invention. It is still more preferably 69 or less, still more preferably 67 or less, and still more preferably 65 or less.

The very thin steel sheet of the present invention can be produced by the ordinary method of heating and hot rolling the slab or cast slab produced by controlling to the aforesaid composition, thereafter pickling, cold rolling and annealing the hot-rolled steel sheet, and thereafter again conducting cold rolling (re-cold-rolling), but the object of the present invention is to efficiently produce a thin material, so as production conditions there are set for cold reduction ratio, annealing temperature and re-cold-rolling reduction ratio ranges whose application is preferable.

A cold-rolling reduction ratio of 80% or greater is desirable. This is because materials produced at a cold-rolling reduction ratio less than this are usually thick ones, which tend not to experience the issues of passing performance during annealing and the like that the present invention aims to resolve. It is still more preferably 85% or greater, still more preferably 88% or greater, still more preferably 90% or greater, and still more preferably 92% or greater. Although increasingly thin materials are currently emerging, and the trend is toward higher cold-rolling reduction ratios, the upper limit is defined as 99% in view of industrial feasibility.

Basically, annealing is done by continuous annealing. Although the invention characteristics of relatively low annealing temperature, inhibited aging, and good strength-ductility balance can naturally be achieved even by batch annealing, the industrial merit is low in batch annealing, in which no passing performance problem arises and aging is adequately inhibited because the cooling rate of the annealed steel sheet is sufficiently slow. As regards the annealing temperature during continuous annealing, one object of the present invention is to enable the annealing temperature after cold rolling to be reduced, and since the ability to reduce the same is one feature of the present invention, making the annealing temperature after cold rolling 789° C. or less is one preferred mode of the present invention. It is still more preferably 769° C. or less, still more preferably 759° C. or less, still more preferably 739° C. or less, still more preferably 719° C. or less, and still more preferably 699° C. or less. Improving workability by increasing annealing temperature does not, of course, diminish the effects of the present invention. However, when annealing is conducted at too high temperature, caution is required regarding the fact that the carbonitrides characteristic of the present invention melt, so that aging may increase greatly depending on the ensuing cooling rate. The lower temperature limit is defined as 641° C. Considering the fact that with ordinary low-carbon steel produced at a cold reduction of around 90% the recrystallization temperature is as low as about 600° C. and that annealing is generally conducted at about 600 to 680° C., this temperature represents a high-side setting, but, while also depending on the composition and hot-rolling conditions (slab heating temperature, coiling temperature, and the like), it is difficult to realize a good strength-ductility balance at a lower temperature than this. It is still more preferably 661° C. or greater, still more preferably 681° C. or greater, still more preferably 701° C. or greater, still more preferably 721° C. or greater, and still more preferably 741° C. or greater.

Like an ordinary thin material, the present invention steel sheet can be subjected to post-annealing re-cold-rolling for flatness control and/or material property improvement. Re-cold-rolling as termed here ordinarily includes what is called skin-pass rolling. The reduction ratio at this time is preferably made 5% or less.

The reason for this is that, although the steel hardens in wet rolling because rolling at over 5% is unavoidable owing to the general difficulty of controlling reduction to a low level, such a hard material can be produced even by conventional technology without relying on the present invention. The reduction ratio is still more preferably 3% or less, still more preferably 2.5% or less, still more preferably 1.9% or less, and still more preferably 1.4% or less. Needless to say, the anti-aging property improves as hardness increases with increasing reduction ratio.

The present invention steel sheet can also be used as a base sheet for a surface-treated steel sheet, and the effects of the present invention are in no way impaired by the surface treatment. As a surface treatment for automotive, construction material, electric machinery, electric equipment and container applications, it is possible to apply—irrespective of whether by commonly conducted electroplating or hot-dip plating—tin, chromium (tin-free) nickel, zinc, aluminum, iron, alloys of these, and the like. Further, the effects of the invention are not diminished even if utilized as a base sheet for a laminated steel sheet attached with an organic film of the type that has recently come into use.

In the case of use in containers, utilization is possible in various kinds of containers formed by, for instance, drawing, ironing, elongation, and welding. In the container production process, workability is improved for, inter alia, flanging, necking, can bulging, embossing, and seaming, as well as for the scoring and stretching required by the can material.

Embodiments

Steel sheets were produced from 250-mm thick continuously cast slabs by hot rolling, pickling, cold rolling and annealing, followed by re-cold-rolling and subjected to evaluation. The compositions and production conditions, and the characteristics and evaluation results of the obtained steel sheets are shown in Tables 1 to 4.

The mechanical characteristics were measured by tensile testing using JIS No. 5 tensile test pieces.

Hardness, which is an important value in the material quality grade of a steel sheet for containers, was measured using the Rockwell superficial hardness scale HR30T.

For the grain diameter, the average value was calculated by observing and measuring the polished and etched structure of a steel-sheet cross-section with a light microscope.

Aging property was evaluated by conducting tensile testing on a steel sheet aged at 210° C.×30 min using a JIS No. 5 tensile test piece. The ratings were expressed as ○: yield point elongation=0%, ●: 0%<yield point elongation≤0.4%, Δ: 0.4%<yield point elongation 1.4%, and ×: yield point elongation>1.4%.

Hyne testing by a generally conducted method was performed 10 times on weld-fabricated three-piece can bodies and Hyne testability was rated by the number of times that were untestable owing to weld seam fracture. The ratings were expressed as ○: no untestability, Δ: untestable one or two times, and ×: untestable three or more times.

Die-flanging was performed by a generally conducted method on weld-fabricated three-piece can bodies and weld workability was rated by flange projection length limit. The ratings were expressed as ○: 6 mm or greater (excellent), Δ: 3 mm to less than 6 mm (practicable), and ×: less than 3 mm (impracticable).

Surface property was visually tested on a strip passing line as performed in ordinary steel sheet production. The ratings were expressed as ○: excellent (very beautiful), Δ: good (on the general level of a product acceptable for shipping/tolerable surface non-uniformity observed locally but no removal regions present; defective surface regions requiring removal at 3% or less of whole coil), and ×: bad (on no-ship level because removal regions due to defects occurred at greater than 3% to total surface of whole coil).

Annealing-process passing performance was judged by tension controllability for preventing buckling during continuous annealing line pass conducted at an ordinary steel sheet production site. Although the absolute value of tension control of course varies with the line equipment itself, and also to no small degree with steel type, pass speed, sheet size and the like, in these embodiments, 0.3 kgf/mm$^2$ was adopted as a reference for minimum tension (lower limit of tension control) for avoiding sheet deviation (walking) during sheet pass, and assessment was by distance to the heat buckling occurrence threshold tensile force (upper limit of tension control). The ratings were expressed as ○: excellent (large control allowance/control range: 1.4 kgf/mm$^2$ or greater), Δ: good (proper-sheet property production level)/control range: 0.2 kgf/mm$^2$ or greater to less than 1.4 kgf/mm$^2$), and ×: bad (perfect control over full length difficult; slight heat buckling may occur locally/control range: less than 0.2 kgf/mm$^2$).

For material quality uniformity at coil interior, JIS No. 5 tensile test pieces were used to measure 0.2% proof stress at a total of nine points of a produced coil, namely, at the widthwise work side 100 mm region, center region and drive side 100 mm region in the longitudinal top 20 m region, center region and bottom 20 m region, and (difference between maximum value and minimum value)/(average value) was used for evaluation. The ratings were expressed as ○: 0.10 or less, Δ: greater than 0.10 to 0.20 or less, and ×: greater than 0.20.

As is clear from the results, the invention examples produced within the range of the present invention exhibited good characteristics, while the comparative examples produced outside the range of the present invention had some × evaluation result, thus demonstrating the effect of the present invention.

| | Composition (mass %) | | | | | | | | | Control factors | | | | | | |
|---|---|---|---|---|---|---|---|---|---|---|---|---|---|---|---|---|
| Steel | C | Si | Mn | P | S | Al | N | Ti | Nb | N − C | C + N | Al/N | Ti + Nb | (Ti + Nb)/Al | (Ti/48 + Nb/93)/C × 12 | (Ti/48 + Nb/93)/(C/12 + N/14) |
| 1 | 0.0017 | 0.008 | 0.23 | 0.009 | 0.0065 | 0.095 | 0.0072 | 0.0132 | 0.0153 | 0.0055 | 0.0089 | 13.2 | 0.0285 | 0.3000 | 3.1025 | 0.3700 |
| 2 | 0.0017 | 0.008 | 0.23 | 0.009 | 0.0065 | 0.095 | 0.0072 | 0.0132 | 0.0153 | 0.0055 | 0.0089 | 13.2 | 0.0285 | 0.3000 | 3.1025 | 0.6700 |
| 3 | 0.0022 | 0.008 | 0.45 | 0.01 | 0.0073 | 0.095 | 0.0064 | 0.0167 | 0.0147 | 0.0042 | 0.0086 | 14.8 | 0.0313 | 0.3305 | 2.7599 | 0.7900 |
| 4 | 0.0028 | 0.008 | 0.51 | 0.004 | 0.0026 | 0.102 | 0.0049 | 0.0169 | 0.0191 | 0.0021 | 0.0077 | 20.8 | 0.036 | 0.3529 | 2.3891 | 0.9556 |
| 5 | 0.0020 | 0.008 | 0.27 | 0.012 | 0.0005 | 0.123 | 0.0108 | 0.0145 | 0.0158 | 0.0088 | 0.0128 | 11.4 | 0.0303 | 0.2463 | 2.8319 | 0.5031 |
| 6 | 0.0018 | 0.008 | 0.44 | 0.011 | 0.0069 | 0.163 | 0.0076 | 0.0129 | 0.0147 | 0.0058 | 0.0094 | 21.3 | 0.0277 | 0.1693 | 2.8454 | 0.6160 |
| 7 | 0.0016 | 0.008 | 0.35 | 0.014 | 0.0061 | 0.135 | 0.0051 | 0.026 | 0.0185 | 0.0035 | 0.0067 | 26.5 | 0.0445 | 0.3296 | 5.5544 | 1.4883 |
| 8 | 0.0016 | 0.008 | 0.35 | 0.014 | 0.0061 | 0.135 | 0.0051 | 0.026 | 0.0185 | 0.0035 | 0.0067 | 26.5 | 0.0445 | 0.3296 | 5.5544 | 1.4883 |
| 9 | 0.0016 | 0.008 | 0.35 | 0.014 | 0.0061 | 0.135 | 0.0051 | 0.026 | 0.0185 | 0.0035 | 0.0067 | 26.5 | 0.0445 | 0.3296 | 5.5544 | 1.4883 |
| 10 | 0.0016 | 0.008 | 0.35 | 0.014 | 0.0061 | 0.135 | 0.0051 | 0.026 | 0.0185 | 0.0035 | 0.0067 | 26.5 | 0.0445 | 0.3296 | 5.5544 | 1.4883 |
| 11 | 0.0016 | 0.008 | 0.35 | 0.014 | 0.0061 | 0.135 | 0.0051 | 0.026 | 0.0185 | 0.0035 | 0.0067 | 26.5 | 0.0445 | 0.3296 | 5.5544 | 1.4883 |
| 12 | 0.0016 | 0.008 | 0.35 | 0.014 | 0.0061 | 0.135 | 0.0051 | 0.026 | 0.0185 | 0.0035 | 0.0067 | 26.5 | 0.0445 | 0.3296 | 5.5544 | 1.4883 |
| 13 | 0.0017 | 0.010 | 0.28 | 0.008 | 0.0085 | 0.078 | 0.0056 | 0.007 | 0.0160 | 0.0039 | 0.0073 | 13.9 | 0.023 | 0.2949 | 2.2438 | 0.5868 |
| 14 | 0.0017 | 0.010 | 0.28 | 0.008 | 0.0085 | 0.078 | 0.0056 | 0.007 | 0.0160 | 0.0039 | 0.0073 | 13.9 | 0.023 | 0.2949 | 2.2438 | 0.5868 |
| 15 | 0.0014 | 0.007 | 0.32 | 0.001 | 0.0053 | 0.082 | 0.007 | 0.025 | 0.0260 | 0.0055 | 0.0084 | 11.8 | 0.051 | 0.6220 | 6.8606 | 1.2980 |
| 16 | 0.0041 | 0.008 | 0.26 | 0.008 | 0.0008 | 0.15 | 0.0101 | 0.047 | 0.0157 | 0.006 | 0.0142 | 14.8 | 0.0627 | 0.4180 | 3.3600 | 1.0799 |
| 17 | 0.0041 | 0.008 | 0.26 | 0.008 | 0.0008 | 0.15 | 0.0101 | 0.047 | 0.0157 | 0.006 | 0.0142 | 14.8 | 0.0627 | 0.4180 | 3.3600 | 1.0799 |
| 18 | 0.0041 | 0.008 | 0.26 | 0.008 | 0.0008 | 0.15 | 0.0101 | 0.047 | 0.0157 | 0.006 | 0.0142 | 14.8 | 0.0627 | 0.4180 | 3.3600 | 1.0799 |
| 19 | 0.0041 | 0.008 | 0.26 | 0.008 | 0.0008 | 0.15 | 0.0101 | 0.047 | 0.0157 | 0.006 | 0.0142 | 14.8 | 0.0627 | 0.4180 | 3.3600 | 1.0799 |
| 20 | 0.0041 | 0.008 | 0.26 | 0.008 | 0.0008 | 0.15 | 0.0101 | 0.047 | 0.0157 | 0.006 | 0.0142 | 14.8 | 0.0627 | 0.4180 | 3.3600 | 1.0799 |
| 21 | 0.0022 | 0.008 | 0.38 | 0.01 | 0.008 | 0.143 | 0.0048 | 0.034 | 0.008 | 0.0026 | 0.0071 | 29.6 | 0.042 | 0.2937 | 4.3328 | 1.5096 |
| 22 | 0.0022 | 0.008 | 0.38 | 0.01 | 0.008 | 0.143 | 0.0048 | 0.034 | 0.008 | 0.0026 | 0.0071 | 29.6 | 0.042 | 0.2937 | 4.3328 | 1.5096 |
| 23 | 0.0022 | 0.008 | 0.38 | 0.01 | 0.008 | 0.143 | 0.0048 | 0.034 | 0.008 | 0.0026 | 0.0071 | 29.6 | 0.042 | 0.2937 | 4.3328 | 1.5096 |
| 24 | 0.0022 | 0.008 | 0.38 | 0.01 | 0.008 | 0.143 | 0.0048 | 0.034 | 0.008 | 0.0026 | 0.0071 | 29.6 | 0.042 | 0.2937 | 4.3328 | 1.5096 |
| 25 | 0.0022 | 0.008 | 0.38 | 0.01 | 0.008 | 0.143 | 0.0048 | 0.034 | 0.008 | 0.0026 | 0.0071 | 29.6 | 0.042 | 0.2937 | 4.3328 | 1.5096 |
| 26 | 0.0007 | 0.009 | 0.07 | 0.008 | 0.0074 | 0.176 | 0.0055 | 0.002 | 0.028 | 0.0048 | 0.0062 | 31.9 | 0.03 | 0.1705 | 5.8756 | 0.7596 |
| 27 | 0.0013 | 0.007 | 0.48 | 0.01 | 0.0048 | 0.085 | 0.0043 | 0.026 | 0.0183 | 0.003 | 0.0056 | 19.8 | 0.0443 | 0.5212 | 6.8164 | 1.7773 |
| 28 | 0.0018 | 0.009 | 0.46 | 0.014 | 0.0066 | 0.161 | 0.009 | 0.016 | 0.033 | 0.0072 | 0.0109 | 17.8 | 0.049 | 0.3043 | 4.5878 | 0.8680 |
| 29 | 0.0018 | 0.009 | 0.46 | 0.014 | 0.0066 | 0.161 | 0.009 | 0.016 | 0.033 | 0.0072 | 0.0109 | 17.8 | 0.049 | 0.3043 | 4.5878 | 0.8680 |
| 30 | 0.0024 | 0.015 | 0.76 | 0.015 | 0.0118 | 0.197 | 0.0127 | 0.0213 | 0.0134 | 0.0103 | 0.0151 | 15.5 | 0.0347 | 0.1761 | 2.9392 | 0.5309 |
| 31 | 0.0055 | 0.008 | 0.62 | 0.012 | 0.0223 | 0.147 | 0.0077 | 0.009 | 0.022 | 0.0022 | 0.0132 | 19.0 | 0.031 | 0.2109 | 0.9252 | 0.4206 |
| 32 | 0.0037 | 0.013 | 0.61 | 0.012 | 0.009 | 0.099 | 0.0061 | 0.002 | 0.0292 | 0.0024 | 0.0098 | 16.3 | 0.0312 | 0.3152 | 1.1534 | 0.4780 |
| 33 | 0.0088 | 0.434 | 0.65 | 0.013 | 0.0335 | 0.62 | 0.0111 | 0.0247 | 0.0164 | 0.0023 | 0.0199 | 55.9 | 0.0411 | 0.0663 | 0.9422 | 0.4527 |
| 34 | 0.0018 | 0.554 | 0.13 | 0.017 | 0.0056 | 1.197 | 0.0135 | 0.0233 | 0.0568 | 0.0118 | 0.0153 | 88.4 | 0.0801 | 0.0669 | 7.3078 | 0.9837 |
| 35 | 0.0027 | 1.420 | 0.85 | 0.01 | 0.0176 | 0.357 | 0.0092 | 0.0369 | 0.0133 | 0.0065 | 0.0119 | 38.8 | 0.0502 | 0.1406 | 4.0523 | 1.0336 |
| 36 | 0.003 | 0.300 | 1.55 | 0.018 | 0.0166 | 0.431 | 0.0231 | 0.0389 | 0.0346 | 0.02 | 0.0261 | 18.7 | 0.0734 | 0.1705 | 4.7298 | 0.6223 |
| 37 | 0.0015 | 0.448 | 0.41 | 0.034 | 0.0177 | 0.486 | 0.0165 | 0.0582 | 0.026 | 0.015 | 0.018 | 29.5 | 0.0842 | 0.1733 | 11.9366 | 1.1446 |
| 38 | 0.0061 | 0.749 | 1.29 | 0.01 | 0.0292 | 0.831 | 0.0138 | 0.001 | 0.0544 | 0.0078 | 0.0199 | 60.1 | 0.0554 | 0.0667 | 1.917 | 0.4055 |
| 39 | 0.0023 | 0.009 | 0.23 | 0.011 | 0.0065 | 0.106 | 0.0057 | 0.004 | 0.007 | 0.0034 | 0.0079 | 18.8 | 0.011 | 0.1038 | 0.8275 | 0.2649 |
| 40 | 0.0031 | 0.007 | 0.41 | 0.013 | 0.0093 | 0.09 | 0.0092 | 0.007 | 0.0167 | 0.0061 | 0.0123 | 9.8 | 0.0237 | 0.2633 | 1.2596 | 0.3554 |
| 41 | 0.0021 | 0.008 | 0.38 | 0.009 | 0.0091 | 0.088 | 0.0121 | 0.0191 | 0.0186 | 0.01 | 0.0142 | 7.3 | 0.0377 | 0.4284 | 3.4167 | 0.5753 |
| 42 | 0.0021 | 0.008 | 0.38 | 0.009 | 0.0091 | 0.088 | 0.0121 | 0.0191 | 0.0186 | 0.01 | 0.0142 | 7.3 | 0.0377 | 0.4284 | 3.4167 | 0.5753 |
| 43 | 0.0023 | 0.009 | 0.04 | 0.012 | 0.0087 | 0.124 | 0.0085 | 0.005 | 0.009 | 0.0063 | 0.0108 | 14.5 | 0.014 | 0.1129 | 1.0484 | 0.2516 |
| 44 | 0.0025 | 0.009 | 0.29 | 0.002 | 0.0069 | 0.075 | 0.0076 | 0.0145 | 0.038 | 0.0051 | 0.0101 | 9.9 | 0.0525 | 0.7000 | 3.4113 | 0.9461 |
| 45 | 0.0025 | 0.009 | 0.29 | 0.002 | 0.0069 | 0.075 | 0.0076 | 0.0145 | 0.038 | 0.0051 | 0.0101 | 9.9 | 0.0525 | 0.7000 | 3.4113 | 0.9461 |
| 46 | 0.0048 | 0.009 | 0.39 | 0.013 | 0.0075 | 0.082 | 0.0115 | 0.001 | 0.019 | 0.0067 | 0.0163 | 7.1 | 0.02 | 0.2439 | 0.5628 | 0.1843 |
| 47 | 0.0031 | 0.007 | 0.49 | 0.015 | 0.0015 | 0.171 | 0.0077 | 0.002 | 0.019 | 0.0046 | 0.0108 | 22.2 | 0.021 | 0.1228 | 0.9521 | 0.3043 |
| 48 | 0.0025 | 0.015 | 0.73 | 0.02 | 0.0073 | 0.104 | 0.0114 | 0.0284 | 0.0312 | 0.0089 | 0.0139 | 9.1 | 0.0597 | 0.5731 | 4.4503 | 0.9066 |
| 49 | 0.0051 | 0.016 | 0.46 | 0.011 | 0.0094 | 0.105 | 0.0144 | 0.02 | 0.0285 | 0.0093 | 0.0195 | 7.3 | 0.0485 | 0.4619 | 1.7015 | 0.4975 |

-continued

| | Composition (mass %) | | | | | | | | | Control factors | | | | | | |
|---|---|---|---|---|---|---|---|---|---|---|---|---|---|---|---|---|
| Steel | C | Si | Mn | P | S | Al | N | Ti | Nb | N − C | C + N | Al/N | Ti + Nb | (Ti + Nb)/Al | (Ti/48 + Nb/93)/C × 12 | (Ti/48 + Nb/93)/(C/12 + N/14) |
| 50 | 0.0068 | 0.018 | 0.43 | 0.012 | 0.0088 | 0.128 | 0.016 | 0.0185 | 0.0168 | 0.0092 | 0.0228 | 8.0 | 0.0353 | 0.2758 | 0.9989 | 0.3311 |
| 51 | 0.0032 | 0.015 | 0.14 | 0.02 | 0.0066 | 0.146 | 0.0188 | 0.007 | 0.011 | 0.0157 | 0.022 | 7.8 | 0.018 | 0.1233 | 0.9904 | 0.1641 |
| 52 | 0.0014 | 0.018 | 0.56 | 0.006 | 0.0135 | 0.075 | 0.0098 | 0.0136 | 0.014 | 0.0084 | 0.0112 | 7.6 | 0.0276 | 0.3680 | 3.7189 | 0.5313 |
| 53 | 0.0072 | 0.008 | 0.46 | 0.012 | 0.0096 | 0.263 | 0.0217 | 0.016 | 0.0059 | 0.0144 | 0.0289 | 12.1 | 0.0219 | 0.0833 | 0.6613 | 0.1845 |
| 54 | 0.0027 | 0.008 | 0.66 | 0.011 | 0.0072 | 0.171 | 0.0175 | 0.004 | 0.0254 | 0.0147 | 0.0202 | 9.8 | 0.0294 | 0.1719 | 1.5842 | 0.2417 |
| 55 | 0.0007 | 0.439 | 0.63 | 0.019 | 0.0077 | 0.320 | 0.0312 | 0.0202 | 0.010 | 0.0305 | 0.0318 | 10.3 | 0.0302 | 0.0944 | 9.0576 | 0.2310 |

Underlining indicates deviation from some claim.

TABLE 2

| | Production conditions | | | | | | | | Material properties | | | |
|---|---|---|---|---|---|---|---|---|---|---|---|---|
| Steel | Hot-rolled slab temp (° C.) | Coiling temp (° C.) | Hot-rolled sheet thickness (nm) | Cold reduction (%) | Anneal temp (° C.) | Re-cold-roll reduction (%) | Re-cold-roll method | Final Sheet thickness (nm) | Yield stress (MPa) | Tensile strength (MPa) | Uniform elongation (%) | Total elongation (%) |
| 1 | 1150 | 650 | 2.0 | 92 | 720 | 0.8 | Dry | 0.17 | 172 | 303 | 30 | 47 |
| 2 | 1150 | 650 | 2.0 | 92 | 765 | 0.8 | Dry | 0.17 | 139 | 273 | 33 | 48 |
| 3 | 1150 | 680 | 3.6 | 95 | 746 | 0.8 | Dry | 0.18 | 198 | 328 | 25 | 43 |
| 4 | 1100 | 700 | 1.7 | 90 | 740 | 0.8 | Dry | 0.17 | 182 | 312 | 30 | 43 |
| 5 | 1050 | 600 | 1.9 | 93 | 721 | 3.0 | Dry | 0.13 | 207 | 338 | 26 | 43 |
| 6 | 1250 | 550 | 2.5 | 92 | 714 | 2.2 | Dry | 0.20 | 227 | 357 | 26 | 40 |
| 7 | 1100 | 700 | 2.1 | 91 | 709 | 1.0 | Dry | 0.20 | 212 | 343 | 26 | 43 |
| 8 | 1100 | 700 | 2.1 | 91 | 792 | 1.0 | Dry | 0.20 | 164 | 315 | 30 | 43 |
| 9 | 1100 | 700 | 2.1 | 91 | 792 | 5.0 | Wet | 0.19 | 230 | 367 | 23 | 37 |
| 10 | 1100 | 700 | 2.1 | 91 | 792 | 8.0 | Wet | 0.18 | 268 | 401 | 18 | 35 |
| 11 | 1100 | 700 | 2.1 | 91 | 792 | 13.0 | Wet | 0.17 | 342 | 456 | 11 | 23 |
| 12 | 1100 | 700 | 2.1 | 91 | 792 | 20.0 | Wet | 0.16 | 434 | 495 | 2 | 8 |
| 13 | 1100 | 740 | 3.2 | 93 | 712 | 1.4 | Dry | 0.23 | 149 | 282 | 30 | 49 |
| 14 | 1100 | 740 | 3.2 | 93 | 770 | 1.4 | Dry | 0.23 | 116 | 256 | 32 | 51 |
| 15 | 1200 | 600 | 2.4 | 95 | 726 | 1.4 | Dry | 0.13 | 194 | 323 | 26 | 45 |
| 16 | 1180 | 750 | 2.5 | 85 | 739 | 2.5 | Dry | 0.37 | 165 | 297 | 29 | 47 |
| 17 | 1180 | 750 | 2.5 | 85 | 739 | 5.0 | Dry | 0.36 | 200 | 326 | 25 | 42 |
| 18 | 1180 | 750 | 2.5 | 85 | 739 | 10.0 | Wet | 0.34 | 263 | 372 | 17 | 33 |
| 19 | 1180 | 750 | 2.5 | 85 | 739 | 20.0 | Wet | 0.30 | 387 | 467 | 6 | 17 |
| 20 | 1180 | 750 | 2.5 | 85 | 739 | 30.0 | Wet | 0.26 | 515 | 578 | 2 | 5 |
| 21 | 1080 | 710 | 1.8 | 85 | 723 | 1.4 | Dry | 0.27 | 194 | 325 | 26 | 43 |
| 22 | 1080 | 710 | 1.8 | 85 | 723 | 10.0 | Wet | 0.25 | 284 | 420 | 16 | 25 |
| 23 | 1080 | 710 | 1.8 | 85 | 723 | 25.0 | Wet | 0.21 | 444 | 557 | 4 | 12 |
| 24 | 1080 | 710 | 1.8 | 85 | 723 | 35.0 | Wet | 0.18 | 564 | 673 | 1 | 8 |
| 25 | 1080 | 710 | 1.8 | 85 | 723 | 45.0 | Wet | 0.15 | 588 | 712 | 1 | 2 |
| 26 | 1180 | 620 | 2.2 | 95 | 721 | 1.3 | Dry | 0.12 | 157 | 289 | 28 | 51 |
| 27 | 1100 | 690 | 3.0 | 95 | 714 | 1.3 | Dry | 0.15 | 200 | 330 | 28 | 42 |
| 28 | 1230 | 600 | 2.4 | 93 | 743 | 2.2 | Dry | 0.16 | 232 | 362 | 26 | 39 |
| 29 | 1230 | 600 | 2.4 | 93 | 774 | 2.2 | Dry | 0.16 | 219 | 326 | 26 | 41 |
| 30 | 1130 | 640 | 2.1 | 95 | 742 | 2.0 | Dry | 0.11 | 250 | 380 | 25 | 32 |
| 31 | 1100 | 710 | 1.8 | 92 | 707 | 1.3 | Dry | 0.14 | 224 | 353 | 25 | 36 |
| 32 | 1150 | 630 | 2.1 | 93 | 714 | 1.0 | Dry | 0.16 | 232 | 361 | 26 | 38 |
| 33 | 1150 | 690 | 3.3 | 90 | 706 | 2.0 | Dry | 0.32 | 294 | 433 | 21 | 27 |
| 34 | 1100 | 640 | 2.1 | 91 | 735 | 2.5 | Dry | 0.18 | 304 | 454 | 18 | 19 |
| 35 | 1100 | 640 | 2.1 | 93 | 730 | 3.0 | Dry | 0.15 | 398 | 552 | 13 | 16 |
| 36 | 1050 | 690 | 1.6 | 93 | 718 | 1.0 | Dry | 0.12 | 344 | 479 | 17 | 18 |
| 37 | 1050 | 720 | 1.6 | 94 | 748 | 0.8 | Dry | 0.10 | 313 | 455 | 17 | 24 |
| 38 | 1100 | 660 | 1.8 | 93 | 712 | 1.3 | Dry | 0.12 | 370 | 516 | 14 | 16 |
| 39 | 1180 | 680 | 2.0 | 88 | 670 | 1.0 | Dry | 0.24 | 157 | 288 | 26 | 50 |
| 40 | 1200 | 600 | 2.3 | 94 | 719 | 1.0 | Dry | 0.14 | 228 | 357 | 27 | 40 |
| 41 | 1200 | 550 | 2.4 | 93 | 748 | 1.0 | Dry | 0.17 | 220 | 349 | 29 | 42 |
| 42 | 1200 | 550 | 2.4 | 93 | 782 | 1.0 | Dry | 0.17 | 180 | 315 | 31 | 42 |
| 43 | 1100 | 700 | 1.8 | 87 | 684 | 1.0 | Dry | 0.23 | 147 | 280 | 26 | 52 |
| 44 | 1150 | 580 | 2.4 | 87 | 714 | 1.4 | Dry | 0.31 | 177 | 308 | 27 | 47 |
| 45 | 1150 | 580 | 2.4 | 87 | 812 | 1.4 | Dry | 0.31 | 137 | 280 | 30 | 49 |
| 46 | 1250 | 620 | 2.4 | 92 | 730 | 1.3 | Dry | 0.19 | 238 | 366 | 24 | 40 |
| 47 | 1200 | 700 | 2.0 | 94 | 714 | 1.3 | Dry | 0.12 | 227 | 358 | 26 | 38 |
| 48 | 1200 | 570 | 2.5 | 93 | 719 | 1.3 | Dry | 0.18 | 272 | 400 | 23 | 33 |
| 49 | 1050 | 550 | 2.4 | 85 | 721 | 2.0 | Dry | 0.35 | 234 | 363 | 23 | 38 |
| 50 | 1030 | 700 | 1.5 | 90 | 716 | 1.3 | Dry | 0.15 | 225 | 354 | 25 | 38 |

TABLE 2-continued

| | | | | | | | | | | | | |
|---|---|---|---|---|---|---|---|---|---|---|---|---|
| 51 | 1240 | 730 | 1.9 | 91 | 696 | 1.3 | Dry | 0.17 | 237 | 367 | 27 | 41 |
| 52 | 1100 | 650 | 3.0 | 96 | 725 | 1.3 | Dry | 0.16 | 217 | 347 | 25 | 40 |
| 53 | 1050 | 680 | 2.3 | 92 | 713 | 2.0 | Dry | 0.19 | 236 | 366 | 27 | 34 |
| 54 | 1150 | 620 | 2.0 | 87 | 721 | 2.0 | Dry | 0.25 | 242 | 371 | 26 | 34 |
| 55 | 1170 | 610 | 3.0 | 93 | 700 | 1.3 | Dry | 0.21 | 347 | 484 | 18 | 21 |

| | Material properties | | Rating | | | | | | |
|---|---|---|---|---|---|---|---|---|---|
| Steel | Hardness HR30T | Crystal grain diameter (μm) | Aging prop | Hyne Testability | Weld workability | Surface condition | Anneal pass prop | Coil interior uniformity | Evaluation |
| 1 | 50 | 19 | ○ | ○ | ○ | ○ | ○ | ○ | Invention |
| 2 | 47 | 31 | ○ | ○ | ○ | ○ | ○ | ○ | Invention |
| 3 | 61 | 27 | ○ | ○ | ○ | ○ | ○ | ○ | Invention |
| 4 | 56 | 29 | ○ | Δ | Δ | ○ | ○ | ○ | Invention |
| 5 | 59 | 19 | ○ | ○ | ○ | ○ | Δ | ○ | Invention |
| 6 | 60 | 14 | ○ | ○ | ○ | ○ | ○ | ○ | Invention |
| 7 | 55 | 15 | ○ | ○ | Δ | ○ | ○ | Δ | Invention |
| 8 | 51 | 36 | ○ | ○ | Δ | ○ | ○ | Δ | Invention |
| 9 | 56 | 43 | ○ | ○ | Δ | Δ | ○ | Δ | Invention |
| 10 | 62 | 36 | ○ | ○ | Δ | ○ | ○ | Δ | Invention |
| 11 | 70 | 39 | ○ | ○ | Δ | Δ | ○ | Δ | Invention |
| 12 | 75 | 32 | ○ | ○ | Δ | ○ | ○ | Δ | Invention |
| 13 | 50 | 18 | ● | ○ | Δ | ○ | ○ | ○ | Invention |
| 14 | 48 | 38 | ● | ○ | Δ | ○ | ○ | ○ | Invention |
| 15 | 57 | 18 | ○ | ○ | ○ | ○ | Δ | ○ | Invention |
| 16 | 50 | 21 | ○ | ○ | ○ | ○ | Δ | ○ | Invention |
| 17 | 53 | 22 | ○ | ○ | ○ | ○ | Δ | ○ | Invention |
| 18 | 60 | 25 | ○ | ○ | ○ | ○ | Δ | ○ | Invention |
| 19 | 70 | 25 | ○ | ○ | ○ | ○ | Δ | ○ | Invention |
| 20 | 79 | 24 | ○ | ○ | ○ | ○ | Δ | ○ | Invention |
| 21 | 58 | 26 | ○ | Δ | Δ | ○ | ○ | Δ | Invention |
| 22 | 64 | 28 | ○ | Δ | Δ | ○ | ○ | Δ | Invention |
| 23 | 75 | 24 | ○ | Δ | Δ | ○ | ○ | Δ | Invention |
| 24 | 80 | 23 | ○ | Δ | Δ | ○ | ○ | Δ | Invention |
| 25 | 82 | 23 | ○ | Δ | Δ | ○ | ○ | Δ | Invention |
| 26 | 54 | 19 | ○ | ○ | ○ | ○ | ○ | Δ | Invention |
| 27 | 52 | 18 | ○ | Δ | Δ | ○ | Δ | ○ | Invention |
| 28 | 63 | 22 | ○ | ○ | ○ | ○ | ○ | ○ | Invention |
| 29 | 63 | 26 | ○ | ○ | ○ | ○ | ○ | ○ | Invention |
| 30 | 61 | 21 | ○ | ○ | ○ | ○ | ○ | ○ | Invention |
| 31 | 66 | 11 | ● | Δ | Δ | ○ | ○ | ○ | Invention |
| 32 | 62 | 16 | ○ | Δ | Δ | ○ | ○ | ○ | Invention |
| 33 | 71 | 6 | Δ | Δ | Δ | ○ | Δ | Δ | Invention |
| 34 | 75 | 16 | ○ | Δ | ○ | ○ | Δ | Δ | Invention |
| 35 | >90 | 18 | ○ | ○ | ○ | ○ | ○ | Δ | Invention |
| 36 | 77 | 8 | ○ | Δ | ○ | Δ | ○ | ○ | Invention |
| 37 | 73 | 21 | ○ | Δ | ○ | ○ | ○ | Δ | Invention |
| 38 | >90 | 9 | ○ | ○ | ○ | ○ | Δ | Δ | Invention |
| 39 | 54 | 8 | Δ | x | Δ | ○ | ○ | ○ | Comparative |
| 40 | 58 | 15 | ● | ○ | ○ | ○ | ○ | x | Comparative |
| 41 | 61 | 23 | ○ | ○ | ○ | ○ | x | ○ | Comparative |
| 42 | 57 | 29 | ○ | ○ | ○ | ○ | x | ○ | Comparative |
| 43 | 54 | 8 | x | ○ | ○ | ○ | ○ | ○ | Comparative |
| 44 | 54 | 12 | ○ | ○ | ○ | ○ | x | ○ | Comparative |
| 45 | 50 | 30 | ○ | ○ | ○ | ○ | x | ○ | Comparative |
| 46 | 65 | 19 | x | ○ | x | ○ | ○ | ○ | Comparative |
| 47 | 64 | 15.2 | Δ | ○ | ○ | ○ | ○ | x | Comparative |
| 48 | 67 | 11 | ○ | ○ | ○ | ○ | x | ○ | Comparative |
| 49 | 65 | 12 | ○ | ○ | ○ | ○ | x | ○ | Comparative |
| 50 | 64 | 13 | x | ○ | ○ | ○ | ○ | ○ | Comparative |
| 51 | 63 | 7 | x | ○ | ○ | x | ○ | ○ | Comparative |
| 52 | 63 | 19.5 | ○ | ○ | ○ | ○ | x | ○ | Comparative |
| 53 | 67 | 18 | x | ○ | ○ | ○ | Δ | ○ | Comparative |
| 54 | 65 | 16 | x | ○ | ○ | ○ | ○ | ○ | Comparative |
| 55 | 73 | 10 | x | ○ | ○ | Δ | Δ | ○ | Comparative |

Underlining indicates deviation from some claim.

| Steel | Production conditions | | | | | | | | | Material properties | | | | | | |
|---|---|---|---|---|---|---|---|---|---|---|---|---|---|---|---|---|
| | C | Si | Mn | P | S | Al | N | Ti | Nb | N—C | C + N | Al/N | Ti + Nb | (Ti + Nb)/Al | (Ti/48 + Nb/93)/C × 12 | (Ti/48 + Nb/93)/(C/12 + N/14) |
| 56 | 0.0019 | 1.203 | 0.45 | 0.007 | 0.0193 | 0.33 | 0.0368 | 0.0639 | 0.0067 | 0.035 | 0.0387 | 8.9 | 0.0706 | 0.2139 | 8.8629 | 0.5035 |
| 57 | 0.0042 | 0.706 | 0.67 | 0.022 | 0.0298 | 0.669 | 0.0391 | 0.003 | 0.0453 | 0.0349 | 0.0433 | 17.1 | 0.0483 | 0.0722 | 1.5703 | 0.1749 |
| 58 | 0.0027 | 1.345 | 1.32 | 0.028 | 0.0203 | 1.066 | 0.0426 | 0.0098 | 0.0225 | 0.0399 | 0.0454 | 25.0 | 0.0323 | 0.0303 | 1.9827 | 0.1365 |
| 59 | 0.0017 | 0.008 | 0.23 | 0.009 | 0.0065 | 0.095 | 0.0022 | 0.0132 | 0.0153 | 0.0005 | 0.0039 | 43.3 | 0.0285 | 0.3000 | 3.1025 | 1.4709 |
| 60 | 0.0022 | 0.008 | 0.45 | 0.01 | 0.0073 | 0.095 | 0.0018 | 0.0167 | 0.0147 | −0.0004 | 0.004 | 52.6 | 0.0313 | 0.3305 | 2.7599 | 1.6222 |
| 61 | 0.0028 | 0.008 | 0.51 | 0.004 | 0.0026 | 0.102 | 0.0014 | 0.0169 | 0.0191 | −0.0014 | 0.0042 | 72.9 | 0.036 | 0.3529 | 2.3891 | 1.6724 |
| 62 | 0.0023 | 0.009 | 0.23 | 0.011 | 0.0065 | 0.032 | 0.0057 | 0.004 | 0.007 | 0.0034 | 0.0079 | 5.7 | 0.011 | 0.3438 | 0.8275 | 0.2649 |
| 63 | 0.0031 | 0.007 | 0.41 | 0.013 | 0.0093 | 0.061 | 0.0092 | 0.007 | 0.0167 | 0.0061 | 0.0123 | 6.6 | 0.0237 | 0.3885 | 1.2596 | 0.3554 |
| 64 | 0.0021 | 0.008 | 0.38 | 0.009 | 0.0091 | 0.088 | 0.0121 | 0.002 | 0.002 | 0.01 | 0.0142 | 7.3 | 0.004 | 0.0455 | 0.3610 | 0.0608 |
| 65 | 0.0205 | 0.008 | 0.27 | 0.012 | 0.0005 | 0.123 | 0.0108 | 0.0145 | 0.0158 | −0.0097 | 0.0313 | 11.4 | 0.0303 | 0.2463 | 0.2763 | 0.1903 |
| 66 | 0.0018 | 0.008 | 0.44 | 0.011 | 0.0069 | 0.062 | 0.0076 | 0.0129 | 0.0147 | 0.0058 | 0.0094 | 8.1 | 0.0277 | 0.4452 | 2.8454 | 0.6160 |
| 67 | 0.0023 | 0.009 | 0.04 | 0.012 | 0.0087 | 0.124 | 0.0085 | 0.004 | 0.004 | 0.0063 | 0.0108 | 14.5 | 0.008 | 0.0645 | 0.6592 | 0.1582 |
| 68 | 0.0102 | 0.008 | 0.35 | 0.014 | 0.0061 | 0.135 | 0.0051 | 0.095 | 0.0185 | −0.0051 | 0.0153 | 26.5 | 0.1135 | 0.8407 | 2.5625 | 1.7937 |
| 69 | 0.0017 | 0.010 | 0.28 | 0.008 | 0.0085 | 0.078 | 0.0032 | 0.043 | 0.016 | 0.0015 | 0.0049 | 24.4 | 0.059 | 0.7564 | 7.5380 | 2.8843 |
| 70 | 0.0014 | 0.007 | 0.32 | 0.001 | 0.0053 | 0.082 | 0.007 | 0.041 | 0.046 | 0.0055 | 0.0084 | 11.8 | 0.087 | 1.0610 | 11.5611 | 2.1872 |
| 71 | 0.0025 | 0.009 | 0.29 | 0.002 | 0.0069 | 0.011 | 0.0076 | 0.0145 | 0.038 | 0.0051 | 0.0101 | 1.5 | 0.0525 | 4.7727 | 3.4113 | 0.9461 |
| 72 | 0.0021 | 0.008 | 0.26 | 0.008 | 0.0008 | 0.15 | 0.004 | 0.047 | 0.0157 | 0.0019 | 0.0061 | 37.4 | 0.0627 | 0.4180 | 6.5599 | 2.4917 |
| 73 | 0.0022 | 0.008 | 0.38 | 0.01 | 0.0083 | 0.143 | 0.0048 | 0.0005 | 0.008 | 0.0026 | 0.0071 | 29.6 | 0.0085 | 0.0594 | 0.5260 | 0.1833 |
| 74 | 0.0007 | 0.009 | 0.07 | 0.008 | 0.0074 | 0.176 | 0.0044 | 0.002 | 0.028 | 0.0037 | 0.0051 | 39.9 | 0.03 | 0.1705 | 5.8756 | 0.9198 |
| 75 | 0.0005 | 0.007 | 0.48 | 0.01 | 0.0048 | 0.085 | 0.0043 | 0.026 | 0.0183 | 0.0038 | 0.0048 | 19.8 | 0.0443 | 0.5212 | 17.7226 | 2.1170 |
| 76 | 0.0018 | 0.009 | 0.46 | 0.014 | 0.0066 | 0.161 | 0.006 | 0.016 | 0.085 | 0.0042 | 0.0078 | 26.8 | 0.101 | 0.6273 | 8.3154 | 2.1558 |
| 77 | 0.002 | 0.009 | 0.39 | 0.013 | 0.0075 | 0.074 | 0.0174 | 0.001 | 0.016 | 0.0154 | 0.0194 | 4.3 | 0.017 | 0.2297 | 1.1573 | 0.1368 |
| 78 | 0.042 | 0.007 | 0.49 | 0.015 | 0.0015 | 0.171 | 0.0077 | 0.002 | 0.039 | −0.0343 | 0.0497 | 22.2 | 0.041 | 0.2398 | 0.1317 | 0.1138 |
| 79 | 0.0025 | 0.015 | 0.73 | 0.02 | 0.0073 | 0.104 | 0.0042 | 0.0284 | 0.0312 | 0.0017 | 0.0067 | 24.7 | 0.0597 | 0.5731 | 4.4503 | 1.8239 |
| 80 | 0.0051 | 0.016 | 0.46 | 0.011 | 0.0094 | 0.093 | 0.0144 | 0.020 | 0.0285 | 0.0093 | 0.0195 | 6.5 | 0.0485 | 0.5215 | 1.7015 | 0.4975 |
| 81 | 0.0029 | 0.018 | 0.43 | 0.012 | 0.0088 | 0.128 | 0.016 | 0.0185 | 0.002 | 0.0131 | 0.0189 | 8.0 | 0.0205 | 0.1602 | 1.6838 | 0.2939 |
| 82 | 0.0032 | 0.015 | 0.14 | 0.02 | 0.0066 | 0.146 | 0.0188 | 0.085 | 0.011 | 0.0157 | 0.022 | 7.8 | 0.096 | 0.6575 | 7.0842 | 1.1737 |
| 83 | 0.012 | 0.015 | 0.76 | 0.015 | 0.0118 | 0.197 | 0.0147 | 0.0213 | 0.0134 | 0.0027 | 0.0267 | 13.4 | 0.0347 | 0.1761 | 0.5878 | 0.2867 |
| 84 | 0.0032 | 0.008 | 0.62 | 0.012 | 0.0223 | 0.066 | 0.0077 | 0.009 | 0.022 | 0.0045 | 0.0109 | 8.6 | 0.031 | 0.4697 | 1.5902 | 0.5193 |
| 85 | 0.001 | 0.018 | 0.56 | 0.006 | 0.0135 | 0.075 | 0.0039 | 0.0136 | 0.014 | 0.0029 | 0.0049 | 19.2 | 0.0276 | 0.3680 | 5.2065 | 1.1989 |
| 86 | 0.0052 | 0.008 | 0.46 | 0.012 | 0.0096 | 0.263 | 0.0217 | 0.016 | 0.0035 | 0.0164 | 0.0269 | 12.1 | 0.0195 | 0.0741 | 0.8561 | 0.1870 |
| 87 | 0.0037 | 0.013 | 0.61 | 0.012 | 0.009 | 0.099 | 0.002 | 0.002 | 0.0292 | −0.0017 | 0.0057 | 49.6 | 0.0312 | 0.3152 | 1.1534 | 0.7882 |
| 88 | 0.0027 | 0.008 | 0.66 | 0.011 | 0.0072 | 0.034 | 0.003 | 0.004 | 0.0254 | 0.0003 | 0.0057 | 11.3 | 0.0294 | 0.8647 | 1.5842 | 0.8114 |
| 89 | 0.0058 | 0.434 | 0.65 | 0.013 | 0.0335 | 0.62 | 0.0111 | 0.076 | 0.082 | 0.0053 | 0.0169 | 55.9 | 0.158 | 0.2548 | 5.1001 | 1.9316 |
| 90 | 0.0018 | 0.554 | 0.13 | 0.017 | 0.0056 | 0.115 | 0.0104 | 0.0703 | 0.0568 | 0.0086 | 0.0122 | 11.1 | 0.1271 | 1.1052 | 13.8356 | 2.3244 |
| 91 | 0.0255 | 1.42 | 0.85 | 0.01 | 0.0176 | 0.357 | 0.0092 | 0.0369 | 0.0133 | −0.0163 | 0.0347 | 38.8 | 0.0502 | 0.1406 | 0.4291 | 0.3277 |
| 92 | 0.0007 | 0.439 | 0.63 | 0.019 | 0.0077 | 0.32 | 0.0022 | 0.015 | 0.003 | 0.0015 | 0.0029 | 145.5 | 0.018 | 0.0563 | 5.9101 | 1.6000 |
| 93 | 0.003 | 0.3 | 1.55 | 0.018 | 0.0166 | 0.229 | 0.0366 | 0.0389 | 0.0346 | 0.0336 | 0.0396 | 6.3 | 0.0734 | 0.3210 | 4.7298 | 0.4128 |
| 94 | 0.0015 | 0.448 | 0.41 | 0.034 | 0.0177 | 0.089 | 0.0165 | 0.0582 | 0.026 | 0.015 | 0.018 | 5.4 | 0.0842 | 0.9461 | 11.9366 | 1.1446 |
| 95 | 0.0061 | 0.749 | 1.29 | 0.01 | 0.0292 | 0.831 | 0.0041 | 0.001 | 0.0544 | −0.002 | 0.0102 | 202.7 | 0.0554 | 0.0667 | 1.1917 | 0.7561 |
| 96 | 0.0019 | 1.203 | 0.45 | 0.007 | 0.0198 | 0.330 | 0.0368 | 0.0639 | 0.001 | 0.0350 | 0.0387 | 8.9 | 0.0649 | 0.1967 | 8.4758 | 0.4815 |
| 97 | 0.0042 | 0.706 | 0.67 | 0.022 | 0.0298 | 0.669 | 0.0391 | 0.0921 | 0.0453 | 0.0349 | 0.0433 | 17.1 | 0.1374 | 0.2054 | 6.8738 | 0.7655 |
| 98 | 0.066 | 1.345 | 1.32 | 0.028 | 0.0203 | 1.066 | 0.0426 | 0.077 | 0.081 | −0.0234 | 0.1086 | 25.0 | 0.1580 | 0.1482 | 0.4500 | 0.2897 |

Underlining indicates deviation from some claim.

TABLE 4

| Steel | Production conditions | | | | | | | | Material properties | | | |
|---|---|---|---|---|---|---|---|---|---|---|---|---|
| | Hot-rolled slab temp (° C.) | Coiling temp (° C.) | Hot-rolled sheet thickness (nm) | Cold reduction (%) | Anneal temp (° C.) | Re-cold-roll reduction (%) | Re-cold-roll method | Final Sheet thickness (nm) | Yield stress (MPa) | Tensile strength (MPa) | Uniform elongation (%) | Total elongation (%) |
| 56 | 1100 | 660 | 1.8 | 87 | 741 | 1.3 | Dry | 0.23 | 373 | 523 | 15 | 17 |
| 57 | 1050 | 660 | 1.5 | 91 | 702 | 1.0 | Dry | 0.14 | 385 | 529 | 15 | 16 |
| 58 | 1100 | 700 | 1.5 | 93 | 749 | 1.0 | Dry | 0.10 | 503 | 661 | 8 | 10 |
| 59 | 1100 | 650 | 2.0 | 94 | 731 | 2.0 | Dry | 0.12 | 174 | 305 | 27 | 47 |
| 60 | 1100 | 690 | 3.0 | 94 | 746 | 2.5 | Dry | 0.17 | 181 | 312 | 29 | 44 |
| 61 | 1200 | 570 | 2.4 | 91 | 737 | 3.0 | Dry | 0.21 | 209 | 339 | 27 | 42 |
| 62 | 1200 | 600 | 2.3 | 95 | 708 | 1.3 | Dry | 0.12 | 206 | 336 | 26 | 45 |
| 63 | 1200 | 600 | 3.3 | 88 | 718 | 1.0 | Dry | 0.39 | 228 | 357 | 25 | 41 |
| 64 | 1100 | 600 | 1.8 | 92 | 682 | 0.8 | Dry | 0.14 | 197 | 327 | 26 | 43 |
| 65 | 1150 | 600 | 1.9 | 85 | 719 | 1.3 | Dry | 0.28 | 244 | 369 | 25 | 37 |
| 66 | 1080 | 690 | 3.5 | 93 | 718 | 1.3 | Dry | 0.25 | 201 | 331 | 26 | 43 |

TABLE 4-continued

| | | | | | | | | | | | | |
|---|---|---|---|---|---|---|---|---|---|---|---|---|
| 67 | 1180 | 600 | 2.2 | 92 | 677 | 1.0 | Dry | 0.18 | 212 | 342 | 28 | 43 |
| 68 | 1150 | 630 | 2.0 | 94 | 741 | 1.0 | Dry | 0.11 | 225 | 353 | 25 | 40 |
| 69 | 1150 | 610 | 2.1 | 92 | 740 | 2.2 | Dry | 0.17 | 185 | 316 | 27 | 47 |
| 70 | 1100 | 600 | 2.1 | 91 | 748 | 1.3 | Dry | 0.19 | 194 | 324 | 26 | 46 |
| 71 | 1100 | 690 | 3.5 | 94 | 745 | 1.3 | Dry | 0.21 | 186 | 316 | 29 | 47 |
| 72 | 1230 | 600 | 2.5 | 95 | 748 | 1.3 | Dry | 0.13 | 201 | 332 | 28 | 45 |
| 73 | 1090 | 730 | 3.5 | 93 | 690 | 2.0 | Dry | 0.25 | 192 | 323 | 30 | 43 |
| 74 | 1200 | 630 | 1.9 | 90 | 738 | 1.3 | Dry | 0.18 | 185 | 316 | 30 | 45 |
| 75 | 1200 | 770 | 1.6 | 92 | 711 | 1.3 | Dry | 0.13 | 191 | 322 | 28 | 43 |
| 76 | 1100 | 750 | 2.6 | 94 | 706 | 2.0 | Dry | 0.14 | 216 | 346 | 28 | 40 |
| 77 | 1150 | 670 | 2.2 | 85 | 745 | 1.3 | Dry | 0.33 | 218 | 348 | 25 | 41 |
| 78 | 1140 | 670 | 1.8 | 92 | 722 | 1.3 | Dry | 0.13 | 304 | 423 | 21 | 26 |
| 79 | 1250 | 600 | 2.3 | 93 | 715 | 1.4 | Dry | 0.17 | 267 | 395 | 26 | 33 |
| 80 | 1250 | 600 | 2.3 | 94 | 735 | 1.4 | Dry | 0.13 | 238 | 366 | 25 | 38 |
| 81 | 1050 | 690 | 1.7 | 85 | 726 | 1.4 | Dry | 0.25 | 216 | 346 | 25 | 39 |
| 82 | 1200 | 700 | 2.0 | 92 | 741 | 2.5 | Dry | 0.16 | 233 | 364 | 26 | 42 |
| 83 | 1150 | 600 | 3.5 | 95 | 742 | 1.4 | Dry | 0.18 | 260 | 388 | 25 | 29 |
| 84 | 1050 | 720 | 1.5 | 92 | 709 | 1.3 | Dry | 0.12 | 212 | 342 | 27 | 39 |
| 85 | 1200 | 610 | 2.2 | 93 | 746 | 1.3 | Dry | 0.15 | 201 | 331 | 26 | 42 |
| 86 | 1100 | 700 | 3.5 | 95 | 735 | 2.2 | Dry | 0.18 | 230 | 360 | 27 | 35 |
| 87 | 1100 | 600 | 1.9 | 88 | 703 | 1.3 | Dry | 0.23 | 219 | 348 | 28 | 39 |
| 88 | 1100 | 650 | 1.7 | 92 | 749 | 1.3 | Dry | 0.14 | 199 | 328 | 29 | 41 |
| 89 | 1150 | 600 | 2.7 | 93 | 705 | 0.8 | Dry | 0.19 | 314 | 454 | 22 | 24 |
| 90 | 1150 | 600 | 2.0 | 93 | 715 | 0.8 | Dry | 0.13 | 277 | 417 | 24 | 36 |
| 91 | 1200 | 600 | 2.3 | 94 | 729 | 0.8 | Dry | 0.14 | 454 | 601 | 13 | 14 |
| 92 | 1220 | 580 | 2.4 | 91 | 714 | 1.0 | Dry | 0.21 | 292 | 431 | 21 | 27 |
| 93 | 1200 | 630 | 2.2 | 92 | 731 | 1.0 | Dry | 0.18 | 376 | 508 | 16 | 17 |
| 94 | 1100 | 660 | 1.8 | 94 | 723 | 1.0 | Dry | 0.11 | 318 | 455 | 21 | 29 |
| 95 | 1150 | 610 | 2.0 | 92 | 700 | 3.0 | Dry | 0.16 | 363 | 509 | 18 | 22 |
| 96 | 1190 | 610 | 2.3 | 88 | 710 | 2.2 | Dry | 0.27 | 395 | 545 | 16 | 17 |
| 97 | 1140 | 670 | 2.5 | 90 | 734 | 1.0 | Dry | 0.24 | 391 | 535 | 15 | 18 |
| 98 | 1100 | 610 | 2.1 | 91 | 724 | 1.8 | Dry | 0.18 | 672 | 810 | 5 | 7 |

| | Material properties | | Rating | | | | | | |
|---|---|---|---|---|---|---|---|---|---|
| Steel | Hardness HR30T | Crystal grain diameter (μm) | Aging prop | Hyne Testability | Weld workability | Surface condition | Anneal pass prop | Coil interior uniformity | Evaluation |
| 56 | 81 | 28 | ○ | x | ○ | x | ○ | ○ | Comparative |
| 57 | 87 | 4 | Δ | ○ | ○ | x | Δ | ○ | Comparative |
| 58 | >90 | 23 | Δ | ○ | ○ | x | x | ○ | Comparative |
| 59 | 50 | 28 | ○ | x | x | 0 | x | Δ | Comparative |
| 60 | 55 | 44 | ○ | x | x | x | x | Δ | Comparative |
| 61 | 62 | 33 | ○ | x | x | x | x | Δ | Comparative |
| 62 | 52 | 18 | x | Δ | x | 0 | ○ | ○ | Comparative |
| 63 | 61 | 16 | x | ○ | Δ | 0 | ○ | ○ | Comparative |
| 64 | 57 | 19 | x | ○ | Δ | 0 | Δ | x | Comparative |
| 65 | 61 | 13 | x | Δ | Δ | 0 | ○ | ○ | Comparative |
| 66 | 53 | 16 | x | ○ | ○ | 0 | x | x | Comparative |
| 67 | 59 | 13 | x | ○ | Δ | 0 | Δ | x | Comparative |
| 68 | 58 | 20.2 | ○ | x | x | x | x | Δ | Comparative |
| 69 | 52 | 25 | ○ | x | x | 0 | x | ○ | Comparative |
| 70 | 54 | 29 | ○ | x | Δ | 0 | x | ○ | Comparative |
| 71 | 52 | 24 | ○ | x | Δ | 0 | Δ | x | Comparative |
| 72 | 57 | 30 | ○ | x | x | 0 | x | Δ | Comparative |
| 73 | 60 | 17 | x | x | x | 0 | Δ | Δ | Comparative |
| 74 | 55 | 26 | ○ | x | Δ | 0 | Δ | Δ | Comparative |
| 75 | 53 | 22 | ○ | x | Δ | 0 | x | ○ | Comparative |
| 76 | 64 | 14 | ○ | Δ | ○ | 0 | Δ | x | Comparative |
| 77 | 60 | 27 | x | ○ | Δ | 0 | ○ | ○ | Comparative |
| 78 | 69 | 17 | x | Δ | Δ | 0 | x | x | Comparative |
| 79 | 61 | 8 | ○ | x | x | 0 | Δ | ○ | Comparative |
| 80 | 65 | 17 | ○ | ○ | Δ | 0 | x | ○ | Comparative |
| 81 | 56 | 53 | x | ○ | ○ | x | ○ | ○ | Comparative |
| 82 | 55 | 24 | ○ | x | ○ | Δ | x | ○ | Comparative |
| 83 | 64 | 17 | Δ | x | x | 0 | ○ | ○ | Comparative |
| 84 | 63 | 13 | ○ | x | ○ | 0 | x | ○ | Comparative |
| 85 | 52 | 33 | ○ | x | x | 0 | Δ | ○ | Comparative |
| 86 | 66 | 29 | x | ○ | ○ | Δ | Δ | x | Comparative |
| 87 | 61 | 17 | ○ | x | x | 0 | ○ | x | Comparative |
| 88 | 56 | 31 | ○ | x | x | 0 | x | ○ | Comparative |
| 89 | 77 | 3 | ○ | x | Δ | 0 | ○ | x | Comparative |
| 90 | 62 | 10 | ○ | x | ○ | 0 | Δ | ○ | Comparative |
| 91 | >90 | 14 | x | Δ | Δ | 0 | ○ | x | Comparative |
| 92 | 66 | 48 | Δ | Δ | x | Δ | x | x | Comparative |
| 93 | 86 | 15 | ○ | Δ | Δ | Δ | ○ | x | Comparative |
| 94 | 68 | 15 | ○ | x | Δ | 0 | Δ | ○ | Comparative |

TABLE 4-continued

| | | | | | | | | | |
|---|---|---|---|---|---|---|---|---|---|
| 95 | 83 | 7 | ○ | x | x | 0 | x | x | Comparative |
| 96 | 89 | 40 | ○ | ○ | ○ | x | ○ | ○ | Comparative |
| 97 | 89 | 15 | ○ | Δ | ○ | x | ○ | ○ | Comparative |
| 98 | >90 | 7 | x | x | Δ | x | ○ | x | Comparative |

Underlining indicates deviation from some claim.

INDUSTRIAL APPLICABILITY

According to the present invention, it is possible to obtain a steel sheet that in addition to being inhibited in aging property also has a good balance between strength and ductility and good welding-related properties. Moreover, as the recrystallization temperature of the invention steel is lower than that of conventional steels, low-temperature annealing is possible, and further, since high-temperature strength is high, high-efficiency production that avoids occurrence of heat buckling particularly in a material of thin thickness is enabled.

The invention claimed is:

1. A very thin steel sheet consisting of, in mass %,

C: 0.0004 to 0.0108%,

N: 0.0032 to 0.0749%,

Si: 0.0001 to 1.99%,

Mn: 0.006 to 1.99%,

S: 0.0001 to 0.089%,

P: 0.001 to 0.069%, and

Al: 0.206 to 1.99%;

further consisting of one or both of Ti and Nb at

Ti: 0.0005 to 0.0804%, and

Nb: 0.0051 to 0.0894%, within the range of

Ti+Nb: 0.0101 to 0.1394%;

further satisfying the relationships of $N-C \geq 0.0020\%$, $C+N \geq 0.0054\%$, $Al/N > 10$, $(Ti+Nb)/Al \leq 0.8$, $(Ti/48+Nb/93) \times 12/C \geq 0.5$, and $0.31 < (Ti/48+Nb/93)/(C/12+N/14) \leq 2.0$;

having a balance of iron and unavoidable impurities; and having a thickness of 0.4 mm or less, wherein:

a yield point elongation of a JIS No. 5 tensile test piece of the steel sheet aged at 210° C. for 30 minutes is 0.4% or less, in a Hyne test performed 10 times on weld-fabricated three-piece can bodies, a number of times that weld seam fractures are present is 2 times or less, wherein, in the Hyne test, the weld seam is pulled so as to tear the weld at a weld heat-affected zone, and a flange projection length limit is 3 mm or more, the flange projection being measured after die-flanging on the weld-fabricated three-piece can bodies.

2. The very thin steel sheet as set out in claim 1, having an average grain diameter of 30 μm or less.

3. The very thin steel sheet as set out in claim 1 or 2, having a superficial hardness HR30T of 51 to 71, a yield stress of 200 to 400 MPa, a tensile strength of 320 to 450 MPa, and a total elongation of 15 to 45%.

4. A method of producing a very thin steel sheet set out in claim 1, wherein the method comprises heating and hot rolling a slab or cast slab having a composition of said very thin steel sheet, thereafter conducting cold rolling at a cold-rolling reduction ratio of 80% to 99%, and performing annealing to attain a recrystallization rate of 100%.

5. The method of producing a very thin steel sheet as set out in claim 4, wherein the annealing after the cold rolling is conducted by continuous annealing with an annealing temperature of 641° C. to 789° C.

6. The method of producing a very thin steel sheet as set out in claim 4 or 5, further comprising a re-cold-rolling by dry rolling after the annealing, with a re-cold-rolling reduction ratio of 5% or less.

* * * * *